US006134837A

United States Patent [19]

Kawanobe et al.

[11] Patent Number: 6,134,837

[45] **Date of Patent: *Oct. 24, 2000**

[54] DOOR HOLDING CONTROL SYSTEM FOR A VEHICLE SLIDE DOOR

[75] Inventors: Osamu Kawanobe; Ryoji Shimura, both of Kanagawa, Japan

[73] Assignee: Ohi Seisakusho Co., Ltd., Yokohama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/003,755

[22] Filed: Jan. 7, 1998

[30] Foreign Application Priority Data

Jan. 7, 1997 [JP] Japan ..... 9-011939

[51] Int. Cl.[7] ..... E05F 11/00

[52] U.S. Cl. ..... 49/360

[58] Field of Search ..... 49/360, 25, 26, 49/28, 280

[56] References Cited

U.S. PATENT DOCUMENTS 5,069,000 12/1991 Zuckerman ..... 49/360 X
5,216,838 6/1993 DeLand et al. ..... 49/360 X
5,632,120 5/1997 Shigematsu et al. ..... 49/360 X
5,836,639 11/1998 Kleefeldt et al. ..... 49/360 X

FOREIGN PATENT DOCUMENTS 0 626 498 11/1994 European Pat. Off. .

*Primary Examiner*—Jerry Redman
*Attorney, Agent, or Firm*—Foley & Lardner

[57] ABSTRACT

A door-holding control system for a vehicle slide door includes a slide door moved for its opening and closing on and along a guide track of a vehicle body by a slide door Moving mechanism, a clutch mechanism for interruptively transmitting a mechanical power from a drive source to the slide door moving mechanism, movement detecting element for detecting a movement of the slide door, and a clutch control for controlling a power transmission maintenance force of the clutch mechanism. The door-holding control system in improved such that: the clutch control controls the power transmission maintenance force to a minimal value of force required for stopping and holding the slide door while monitoring an output signal of the movement detecting element, and when the power transmission maintenance force exceeds a predetermined value of force, the clutch control controls the power transmission maintenance force to a value of force required for opening and closing the slide door, whereby the slide door is driven for opening and closing by the mechanical power of the drive source.

9 Claims, 21 Drawing Sheets

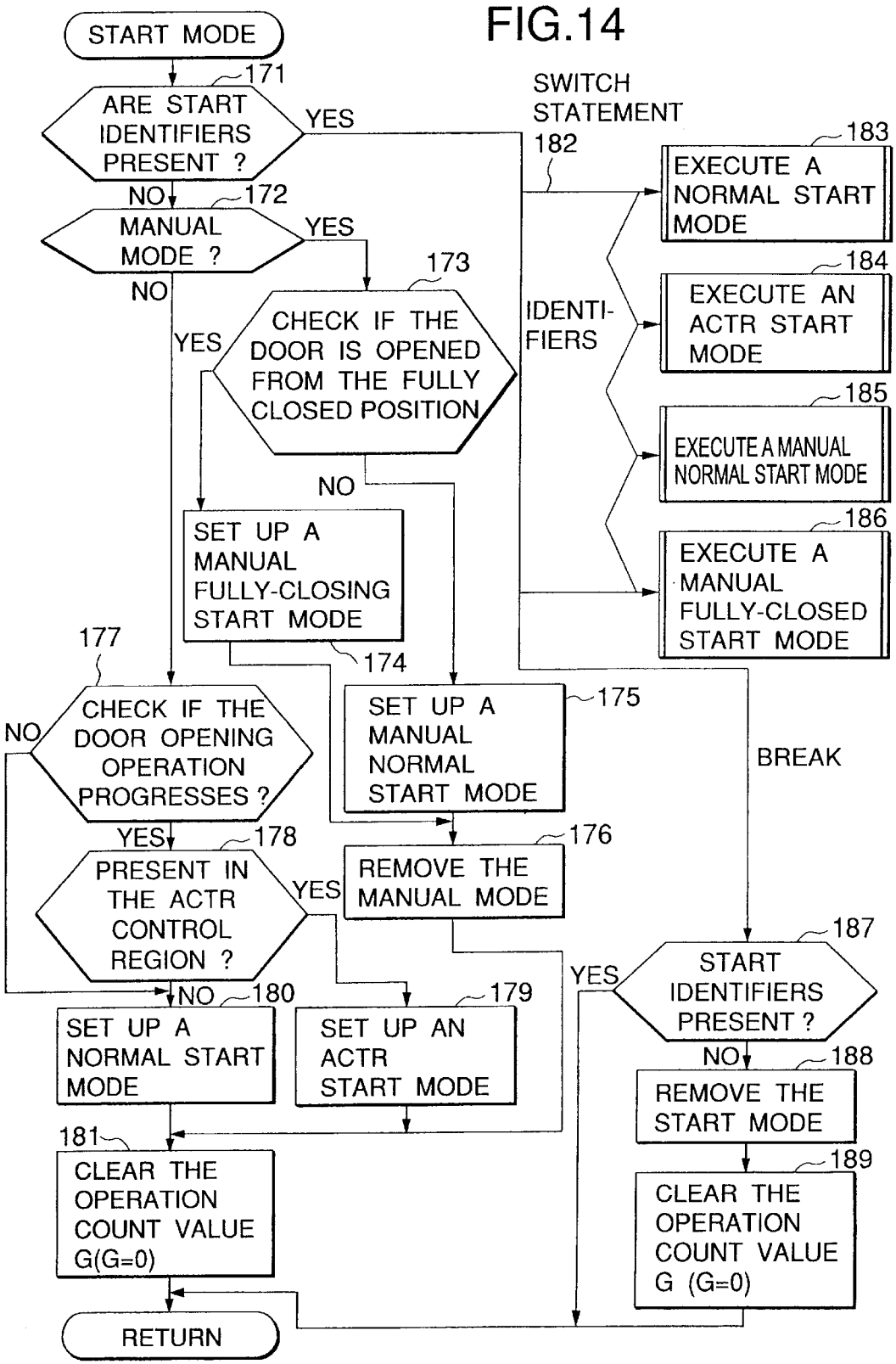
FIG.14
START MODE
171
ARE START IDENTIFIERS PRESENT ?
YES
NO
172
MANUAL MODE ?
YES
NO
173
CHECK IF THE DOOR IS OPENED FROM THE FULLY CLOSED POSITION
YES
NO
SET UP A MANUAL FULLY-CLOSING START MODE
174
177
CHECK IF THE DOOR OPENING OPERATION PROGRESSES ?
NO
YES
178
PRESENT IN THE ACTR CONTROL REGION ?
YES
NO
180
SET UP A NORMAL START MODE
179
SET UP AN ACTR START MODE
181
CLEAR THE OPERATION COUNT VALUE G(G=0)
RETURN
SET UP A MANUAL NORMAL START MODE
175
REMOVE THE MANUAL MODE
176
SWITCH STATEMENT
182
IDENTI-FIERS
183
EXECUTE A NORMAL START MODE
184
EXECUTE AN ACTR START MODE
185
EXECUTE A MANUAL NORMAL START MODE
186
EXECUTE A MANUAL FULLY-CLOSED START MODE
BREAK
187
START IDENTIFIERS PRESENT ?
YES
NO
188
REMOVE THE START MODE
189
CLEAR THE OPERATION COUNT VALUE G (G=0)

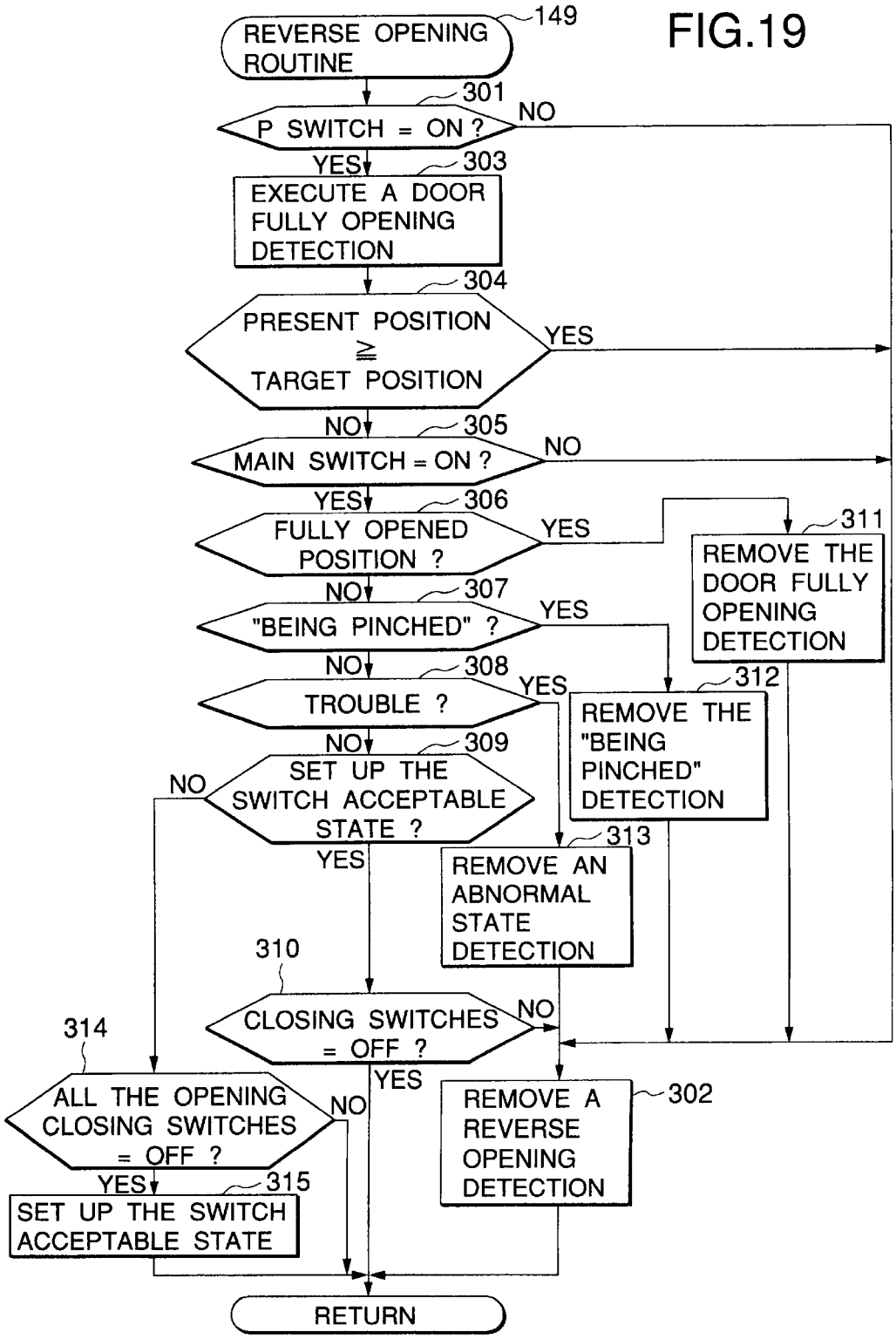
FIG.19
REVERSE OPENING ROUTINE
149
301
P SWITCH = ON ?
NO
YES
303
EXECUTE A DOOR FULLY OPENING DETECTION
304
PRESENT POSITION ≧ TARGET POSITION
YES
NO
305
MAIN SWITCH = ON ?
NO
YES
306
FULLY OPENED POSITION ?
YES
311
REMOVE THE DOOR FULLY OPENING DETECTION
NO
307
"BEING PINCHED" ?
YES
NO
308
TROUBLE ?
YES
312
REMOVE THE "BEING PINCHED" DETECTION
NO
309
SET UP THE SWITCH ACCEPTABLE STATE ?
NO
YES
313
REMOVE AN ABNORMAL STATE DETECTION
310
CLOSING SWITCHES = OFF ?
NO
YES
314
ALL THE OPENING CLOSING SWITCHES = OFF ?
NO
YES
315
SET UP THE SWITCH ACCEPTABLE STATE
REMOVE A REVERSE OPENING DETECTION
302
RETURN

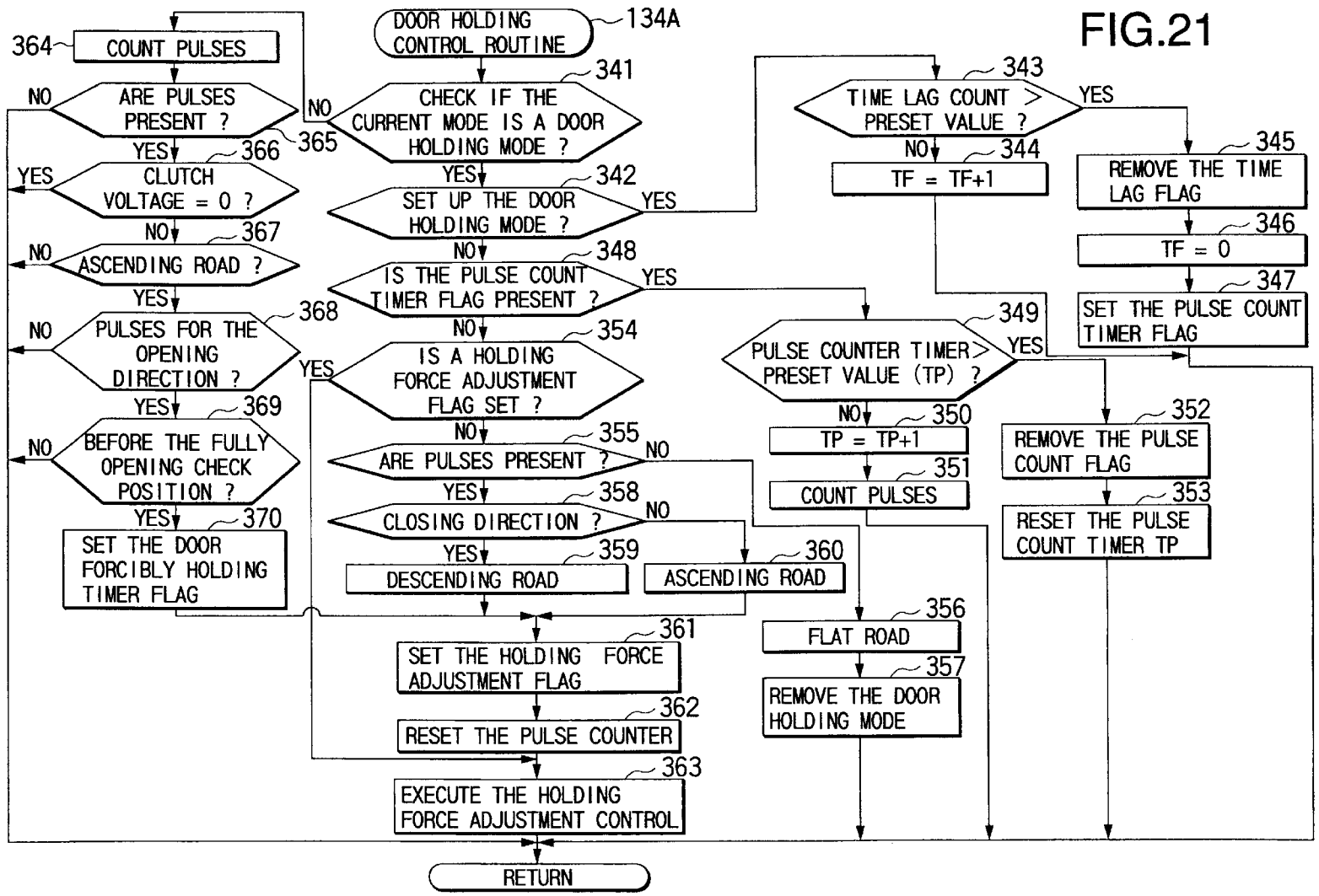
FIG.21
134A
DOOR HOLDING CONTROL ROUTINE
341
CHECK IF THE CURRENT MODE IS A DOOR HOLDING MODE ?
342
SET UP THE DOOR HOLDING MODE ?
348
IS THE PULSE COUNT TIMER FLAG PRESENT ?
354
IS A HOLDING FORCE ADJUSTMENT FLAG SET ?
355
ARE PULSES PRESENT ?
358
CLOSING DIRECTION ?
359
DESCENDING ROAD
360
ASCENDING ROAD
361
SET THE HOLDING FORCE ADJUSTMENT FLAG
362
RESET THE PULSE COUNTER
363
EXECUTE THE HOLDING FORCE ADJUSTMENT CONTROL
RETURN
343
TIME LAG COUNT > PRESET VALUE ?
344
TF = TF+1
345
REMOVE THE TIME LAG FLAG
346
TF = 0
347
SET THE PULSE COUNT TIMER FLAG
349
PULSE COUNTER TIMER > PRESET VALUE (TP) ?
350
TP = TP+1
351
COUNT PULSES
352
REMOVE THE PULSE COUNT FLAG
353
RESET THE PULSE COUNT TIMER TP
356
FLAT ROAD
357
REMOVE THE DOOR HOLDING MODE
364
COUNT PULSES
365
ARE PULSES PRESENT ?
366
CLUTCH VOLTAGE = 0 ?
367
ASCENDING ROAD ?
368
PULSES FOR THE OPENING DIRECTION ?
369
BEFORE THE FULLY OPENING CHECK POSITION ?
370
SET THE DOOR FORCIBLY HOLDING TIMER FLAG
YES
NO

DOOR HOLDING CONTROL SYSTEM FOR A VEHICLE SLIDE DOOR

BACKGROUND OF THE INVENTION

1. Field of the Invention

The present invention relates to a door-holding control system for a vehicle slide door, which holds the slide door that is opened and closed by a drive source, e.g., a motor, while allowing the slide door to be moved from its standstill state by a required force.

2. Description of the Related Art

There is known a control system for automatically opening and closing, by use of a drive source, e.g., a motor, a slide door which is mounted on the side of a vehicle body while being slidable in the lengthwise direction. To drive the slide door for its opening/closing, suitable operation means is located near the driver sent or the door handle. The occupant intentionally operates the operation means.

To fixedly position the slide door when the vehicle in stopped, the control system inhibits the slide door from moving irrespective of the attitude of the vehicle being stopped by not releasing a clutch mechanism that is located between the drive source and the slide door.

In the conventional automatic door control system which includes a reduction gear and a clutch mechanism which are constituted such that a drive source, e.g., a motor, is impossible to turn in the reverse direction or requires a large force to turn in the reverse direction, that is, from the door side to the operation side, when the slide door is stopped and the clutch mechanism is declutched, the slide door is movable by manual operation. When the vehicle is stopped on a steeply sloped road, the mechanism fails to stop and hold the door. The door will be suddenly moved for its opening and closing.

When the sliding movement of the slide door is stopped and the clutch in left operated, the mechanism can hold the slide door even on the sloped road. To manually open and close the door thereafter, a large force is required, and therefore it is almost impossible to manually open and close the door. In some types of the automatic door control system, the start of the door movement made manually is detected and the drive source is driven to move the door. In this type of the door control system, it is undesirable that a force to operate the slide door is abruptly changed when the slider door starts to move.

A proposal is made in which when the slide door is stopped, a clutch voltage is gradually decreased to a voltage slightly higher than the clutch voltage when the slide door starts to move, whereby a power transmission maintenance force of the clutch mechanism is kept at such a value of force that the slide door is not moved by its weight but in movable by the manual operation.

When the slide door is manually operated during the control of the power transmission maintenance force, the clutch voltage increases to stop the slide door. If the manual operation is further continued, the clutch voltage is kept at a further increased value of voltage. The result is that the slide door cannot be opened and closed by manual operation.

SUMMARY OF THE INVENTION

For the above reasons, the present invention has an object to provide a door-holding control system for a vehicle slide door, the system being capable of holding the slide door by such a power transmission maintenance force as to permit the slide door to be movable by the manual operation but to prohibit the slide door from being moved by its weight in any situation.

According to the present invention, there is provided a door-holding control system for a vehicle slide door, comprising: (A) a slide door moving mechanism for moving the slide door along a vehicle body, the slide door moving mechanism including a drive source and a clutch mechanism for interruptively transmitting a mechanical power from the drive source to the slide door; (B) movement detecting means for detecting a movement of the slide door; and (C) clutch control means for controlling a power transmission maintenance force of the clutch mechanism, wherein the clutch control means controls the power transmission maintenance force to a minimal value of force required for stopping and holding the slide door while monitoring an output signal of the movement detecting means.

When the power transmission maintenance force exceeds a predetermined value of force, the clutch control means preferably controls the power transmission maintenance force to a value of force required for opening and closing the slide doors thereby driving the slide door for opening and closing by the mechanical power of the drive source.

When the movement detecting means produces a signal indicating that the slide door has moved from a position near a full-open position to a full-open position and the clutch control means receives the signal from the movement detecting means, the clutch control means preferably controls the power transmission maintenance force to such a value of force as to stop a movement of the slide door to the full-open position, and after a preset time elapses, the clutch control means controls the power transmission maintenance force to a minimal value of force required for stopping and holding the slide door.

When the slide door mover in an opposite direction to a direction in which a weight of the slide door moves the slide door per se, the clutch control means preferably controls the power transmission maintenance force to a value of force required for opening and closing the slide door, thereby driving the slide door in the opposite direction by the mechanical power of the drive source.

In the door-holding control system according to the present inventions when the slide door is held at a position by such a power transmission maintenance force as to allow the slide door to be opened and closed by manual operation, when the power transmission maintenance force exceeds a predetermined value of force, clutch control means judges that the slide door is manually operated/ and controls the power transmission maintenance force so as to set up the automatic door operation mode. Therefore, the slide door can be held at a position by such a power transmission maintenance force as to allow the slide door to manually be opened and closed.

When the slide door is stopped at a position near the full-open position and the door is further moved to the full-open position, the clutch control means increases the power transmission maintenance force to thereby inhibit the movement of the slide door in order that the slide door does not climb over a full-open check mechanism, and thereafter holds the slide door by such a power transmission maintenance force as to allow the slide door to manually be opened and closed.

When the slide door mover in the opposite direction to the direction in which the weight of the slide door moves the slide door per se, the clutch control means judges that the slide door in manually operated, and stops the holding of the elide door based on the half-clutch control and immediately puts the clutch mechanism in a full-clutch state, and sets up the automatic door operation mode.

BRIEF DESCRIPTION OF THE DRAWINGS

In the accompanying drawings:

FIG. 14 is a flow chart showing a start mode routine;

FIG. 19 is a flow chart showing a reverse opening routine;

FIG. 21 is a flow chart showing a door hold control routine; and

DETAILED DESCRIPTION OF THE PREFERRED EMBODIMENTS

Figure 1:
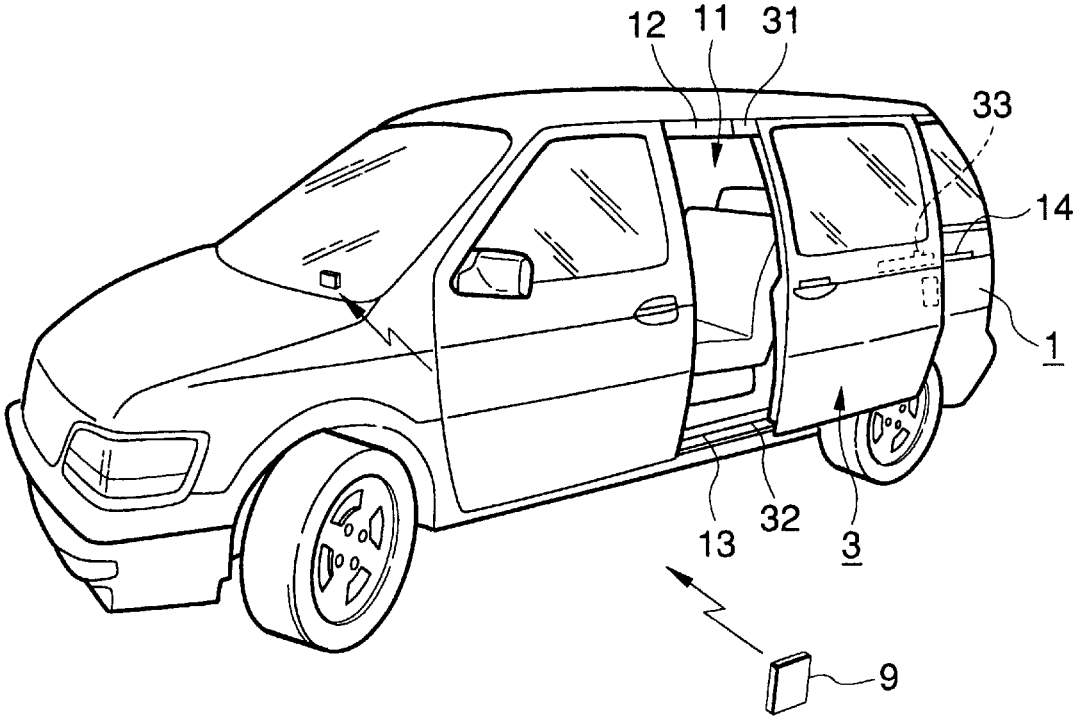
FIG. 1 is a perspective view showing an external appearance of a motor vehicle incorporating a door-holding control system for a vehicle slide door which is constructed according to the present invention.
Figure 2:
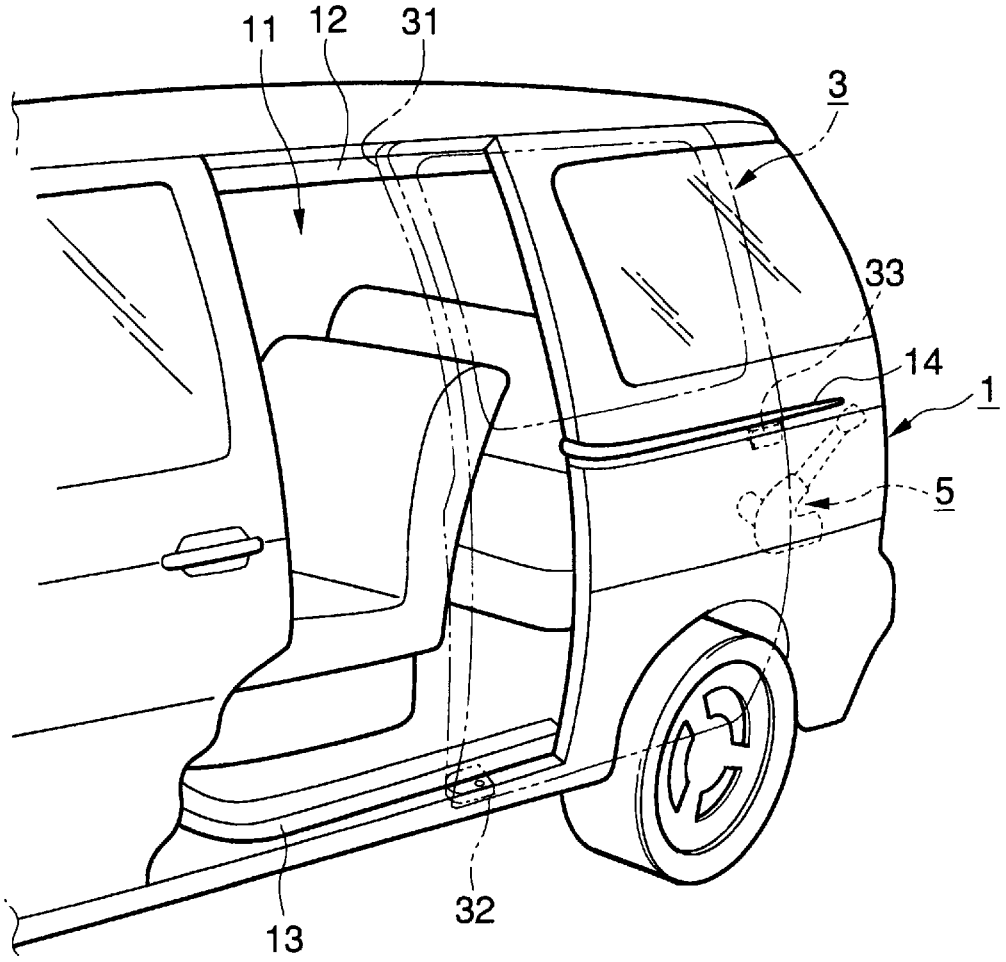
FIG. 2 is an enlarged, perspective view showing a vehicle body when the slide door is removed therefrom.
Figure 3:
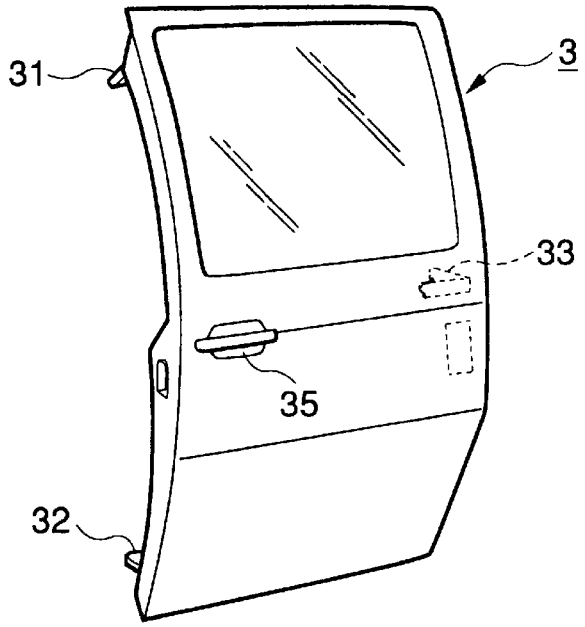
FIG. 3 is a perspective view showing the slide door alone.

FIG. 1 is a perspective view showing an external appearance of a motor vehicle incorporating a door-holding control system for a vehicle slide door which is constructed according to the present invention. As shown, a slide door 3 is mounted on the side of a vehicle body 1 while being longitudinally slidable for its opening and closing. FIG. 2 is an enlarged, perspective view showing the vehicle body 1 when the slide door (indicated by a chain line) is removed, FIG. 3 in a perspective view showing the slide door 3 alone.

In those figures, the slide door 3 is mounted on the vehicle body 1 while being longitudinally slidable in the following way. An upper sliding coupler 31 is fastened on the upper and of the inner side of the slide door 3, and a lower sliding coupler 32 is fastened on the lower end of the door inner side. An upper track 12 is provided along the upper edge of an door opening portion 11 of the vehicle body 1, and a lower track 13 is provided along the lower edge thereof. The upper sliding coupler 31 and the lower sliding coupler 32 are coupled with the upper track 12 and the lower track 13, respectively.

A hinge arm 33 in mounted on the rear end of the inner side of the slide door 3. A guide track 14 is fastened to a portion near the waist of the rear part of the vehicle body 1. The slide door 3 is guided along the guide track 14 in a state that the hinge arm 33 in slidably engaged with the guide track 14. The slide door 3 is moved from a closed position to an open position, while being protruded slightly outward from the outer panel of the vehicle body 1 and in parallel with the outer surface of the outer panel of the vehicle body 1. At the closed position, the door opening portion 11 is tightly closed with the slide door, and at the open position the door opening portion 11 is fully opened. A door handle 35 is mounted on the outer surface of the slide door 3. The door handle is used for manually opening and closing the slide door 3.

Figure 4:
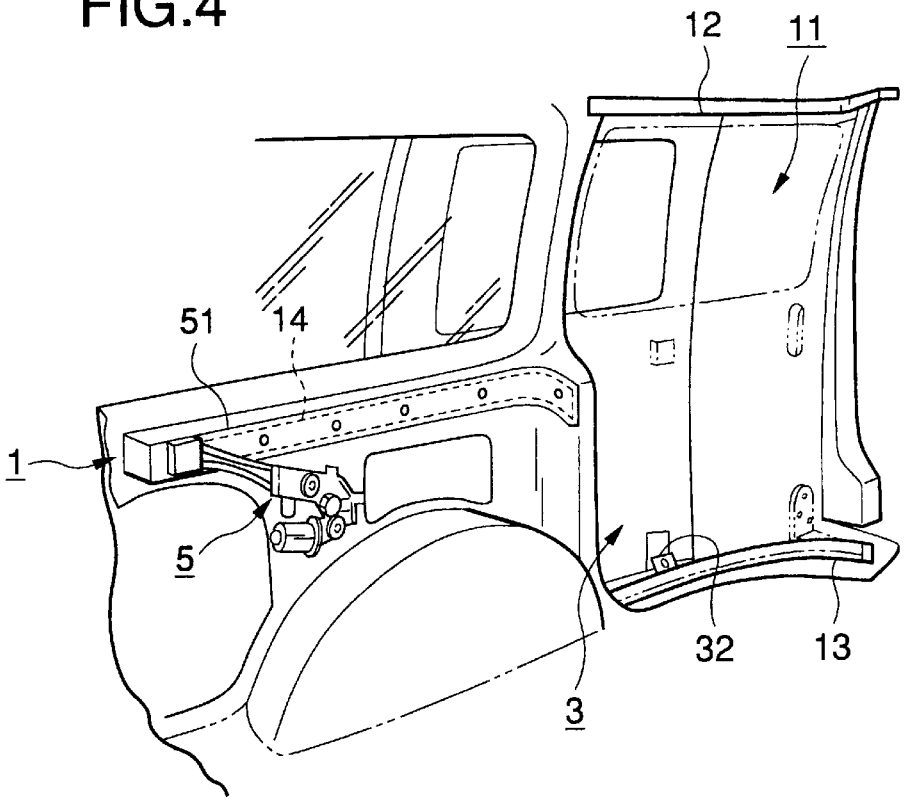
FIG. 4 is a perspective view showing a slide floor mounting portion of the vehicle when viewed from the inside of the vehicle.

As shown in FIG. 4, a slide door drive mechanism 5 is provided in a space between the outer and inner panels of the vehicle body 1. The outer panel demarcates the outside of the vehicle body 1, and the inner panel is located within the vehicle. In the slide door drive mechanism 5, a cable 51, which is disposed within the guide track 14, is coupled with the slide door 3 and a motor. In operation, the slide door 3 is moved for its opening and closing by the cable 51, which is moved by the motor.

In the present embodiment, either open/close switches attached to the inside of the vehicle or a wireless remote switch 9 (FIG. 1) is selectively used for generating open and close instructions. The construction for the open/close instruction generation will be described subsequently.

Figure 5:
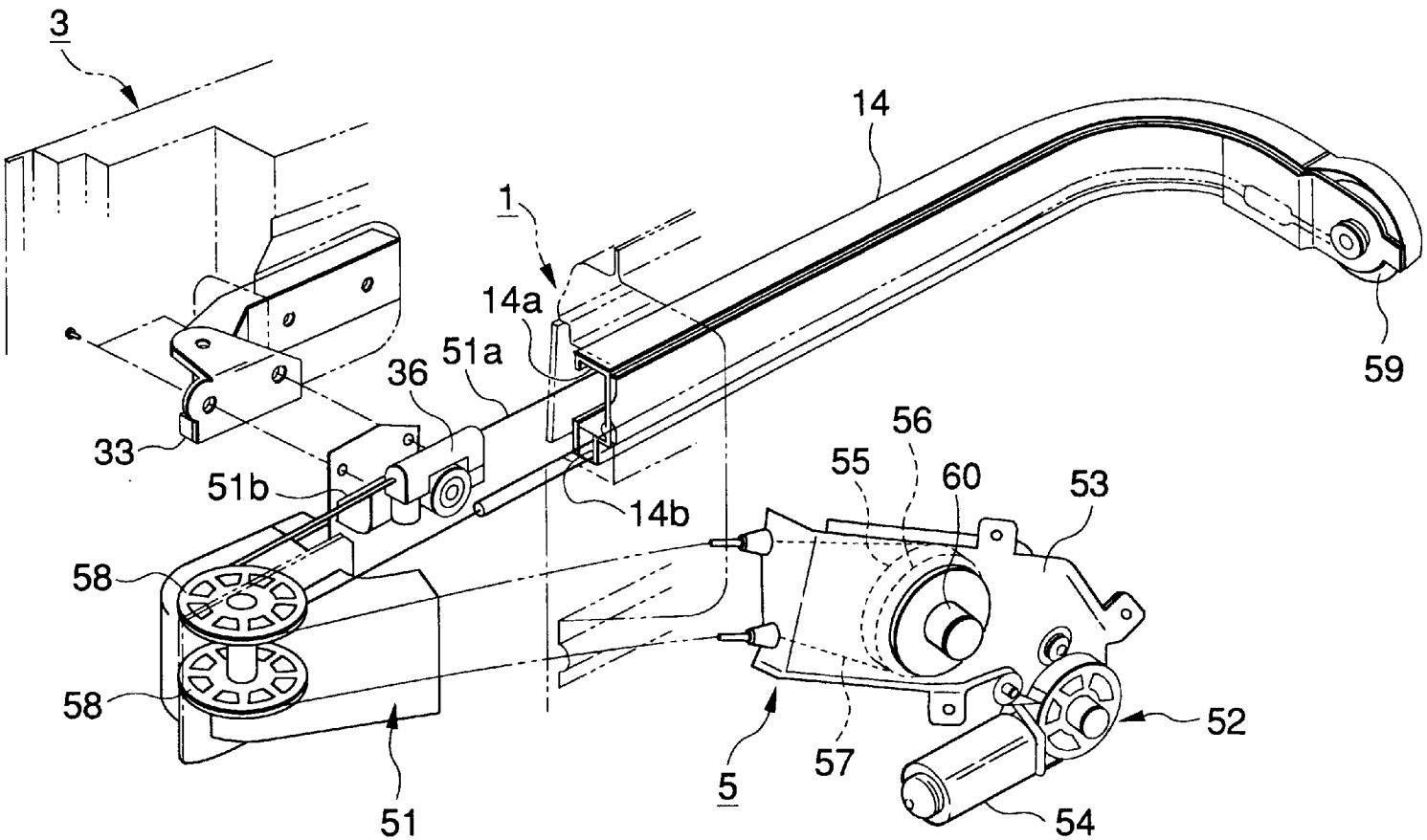
FIG. 5 is a perspective view showing a principal portion of a slide door drive mechanism.

FIG. 5 is a perspective view showing a principal portion of a slide door drive mechanism. As shown, the slide door drive mechanism 5 includes a drive means 52. The drive means 52 includes an open/close motor 54, a drive pulley 55, and a reduction means 57, these being all fastened onto a base plate 53 that is fixed to within the vehicle body 1 by means of bolts, for example. The open/close motor 54 is reversible and for opening and closing the slide door. The cable 51 is wound on the drive pulley 55. The reduction means 57 contains an electromagnetic clutch 56 therein.

A pair of guide pulleys 58 are provided on the rear side of the guide track 14. An upper channel 14*a* and a lower channel 14*b* are formed in the guide track 14 while being parallel to each other. The upper channel 14*a* is shaped like a U while being opened outward. A reversal pulley 59 is provided at the front end of the guide track 14. The cable 51 is wound at one end around the drive pulley 55 and at the other end around the reversal pulley 59 in an endless fashion. The upper cable of the endless cable 51 is put at the mid point on the guide pulleys 58 and passes through the upper channel 14*a* of the guide track 14, while the lower cable thereof is put at the mid point on the guide pulleys 58 and passes through the lower channel 14*b*.

A moving member 36 is secured to an appropriate position of the upper cable of the endless cable 51, which travels through the upper channel 14*a* of the guide track 14. The moving member 36 is secured so as to secure its smooth travelling through the upper channel 14*a*. The fore part of the upper cable with respect to the moving member 36 serves as a door-opening cable 51*a*, while the rear part of the same serves an a door-closing cable 51*b*.

The moving member 36 is coupled with the rear end of the inner aide of the slide door 3 through the hinge arm 33. It is moved forward or backward within the upper channel 14*a* by a pulling force of the door-opening cable 51*a* or the door-closing cable 51*b* to thereby move the slide door 3 in the door closing or opening direction. Thus, the cable 51, guide pulleys 58, reversal pulley 59, hinge arm 33, and the like make up a slide door moving mechanism.

A rotary encoder 60 is coupled with the rotary shaft of the drive pulley 55. The rotary encoder measures a rotation angle of the rotary shaft at a high resolution. With a turn of the drive pulley 55, the rotary encoder 60 generates a pulse signal containing the number of pulses that depends on a rotation angle of the drive pulley 55. The pulse signal represents an mount of the movement of the cable 51 that is wound on tho drive pulley 55, viz., an amount of the movement of the slide door 3. The number of pulses that are generated from the rotary encoder 60 are counted over a range from the closed position of the slide door 3 to the open position, by a proper counter (not shown). Then, a count N of the counter represents a current position of the moving member 36, viz., a current position of the slide door 3.

Figure 6:
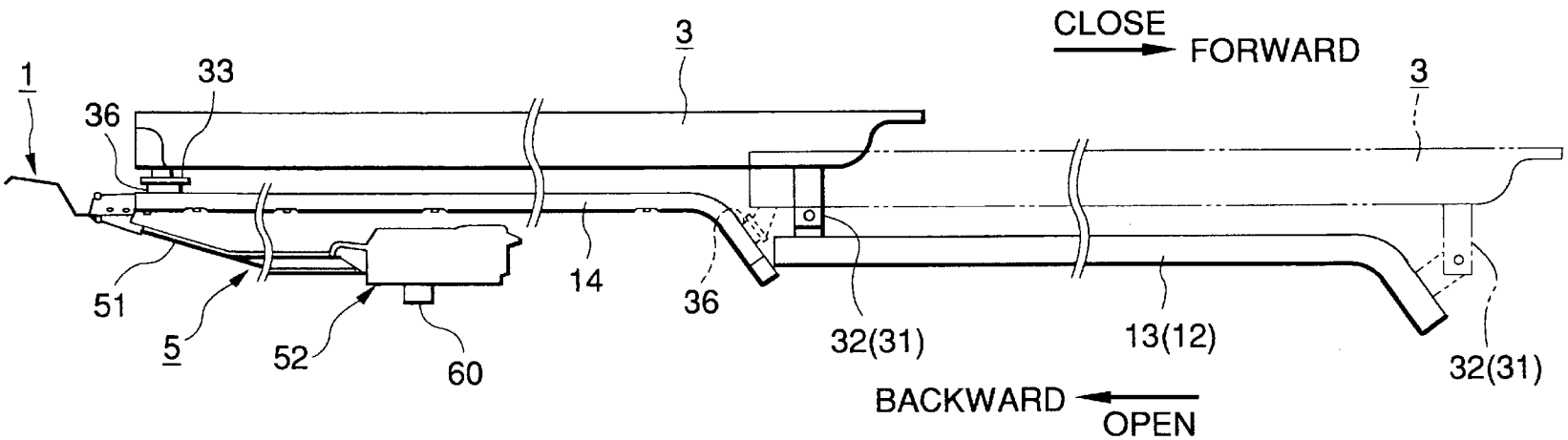
FIG. 6 in a plan view schematically showing a movement of the slide door.

FIG. 6 is a plan view schematically showing a movement of the slide door. As already stated, the upper sliding coupler 31 and the lower sliding coupler 32 are slidably coupled with the upper track 12 and the lower track 13, respectively, to thereby hold the fore part of the slide door 3. The hinge arm 33 is secured to the cable 51 through the moving member 36, to thereby hold the rear part of the slide door 3.

Figure 7:
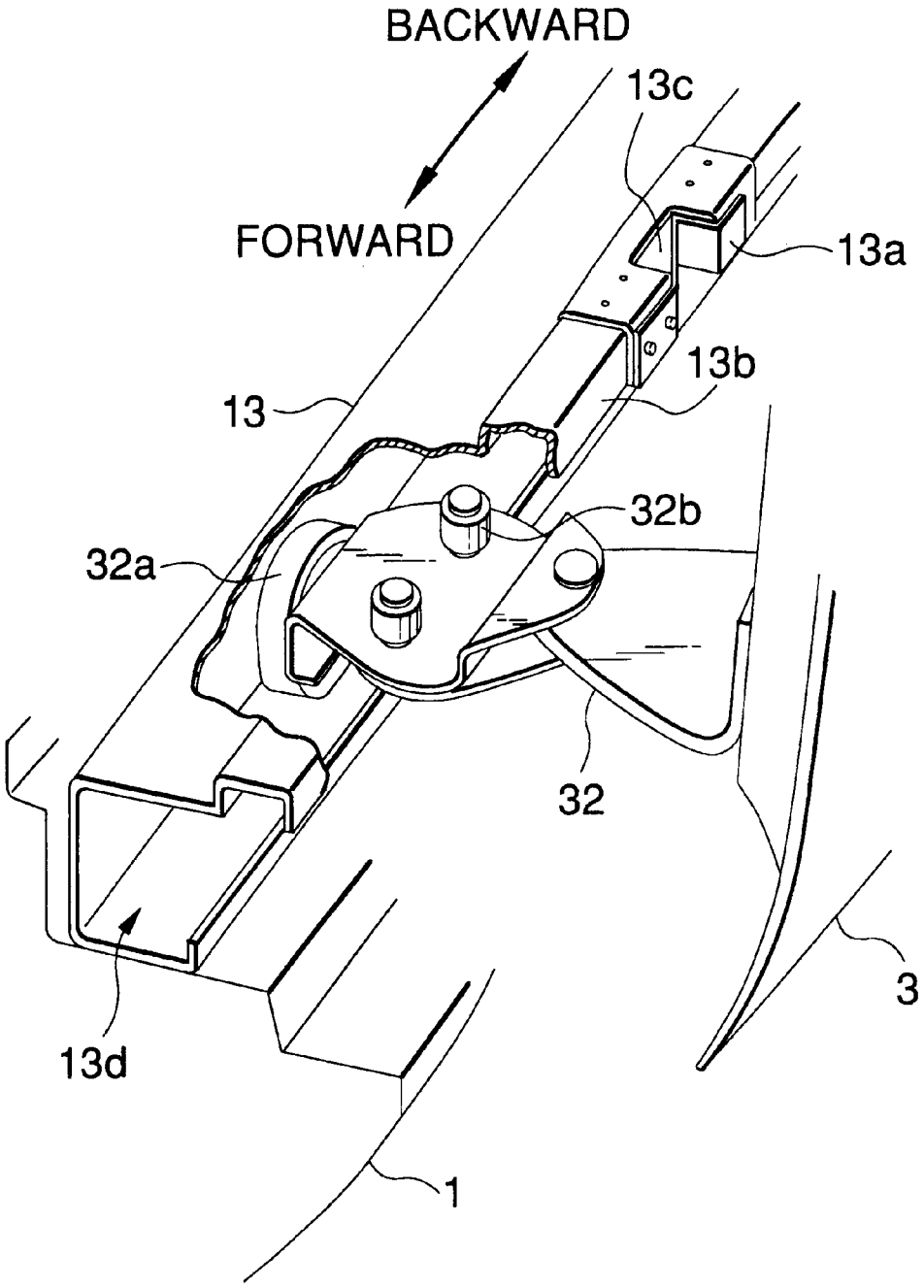
FIG. 7 is a perspective view showing a full-open check mechanism provided on the lower track.

FIG. 7 is a perspective view showing a full-open check mechanism provided on the lower track 13. The full-open check mechanism includes a full-open check member 13*a*. The full-open check member 13*a* has a plate spring member shaped like a V of which one side in steeply slanted and the other side is gently slanted. The full-open check member 13*a* is put in a hole 13*c* of the lower track 13, and the gently slanted aide of the V-shaped full-open check member 13*a* is secured, in a cantilever fashion, to the lower track 13. The hole 13*c* is formed in the upper end face 13*b* of the opening of the lower track 13 as shown.

When the slide door 3 is moved rearward from a position shown, a vertical roller 32*a* rotates on the bottom surface 13*d* of the lower track 13, while a vertical roller 32*a* rotates in contact with the inner surface of the upper end face 13*b*. The vertical roller 32*a* and the horizontal roller 32*b* are coupled with the slide door 3 through the lower sliding coupler 32.

When the horizontal roller 32*b* reaches the full-open check member 13*a,* it pushes aside or outward the gently slanted side of the full-open check member 13*a* and reaches the full open check position. At the full open check position, a further movement of the horizontal roller 32*b* is blocked by the steeply slanted side of the full-open check member 13*a,* and therefore the slide door 3 is held at the full open check position. At this time, the steeply slanted side of the full-open check member 13*a* is slightly slanted. Therefore, if a strong force is applied to the door, the horizontal roller 32*b* pushes outward the steeply slanted side of the full-open check member 13*a* and moves forward.

Slide Door Control Unit and its Peripheral Devices

Figure 8:
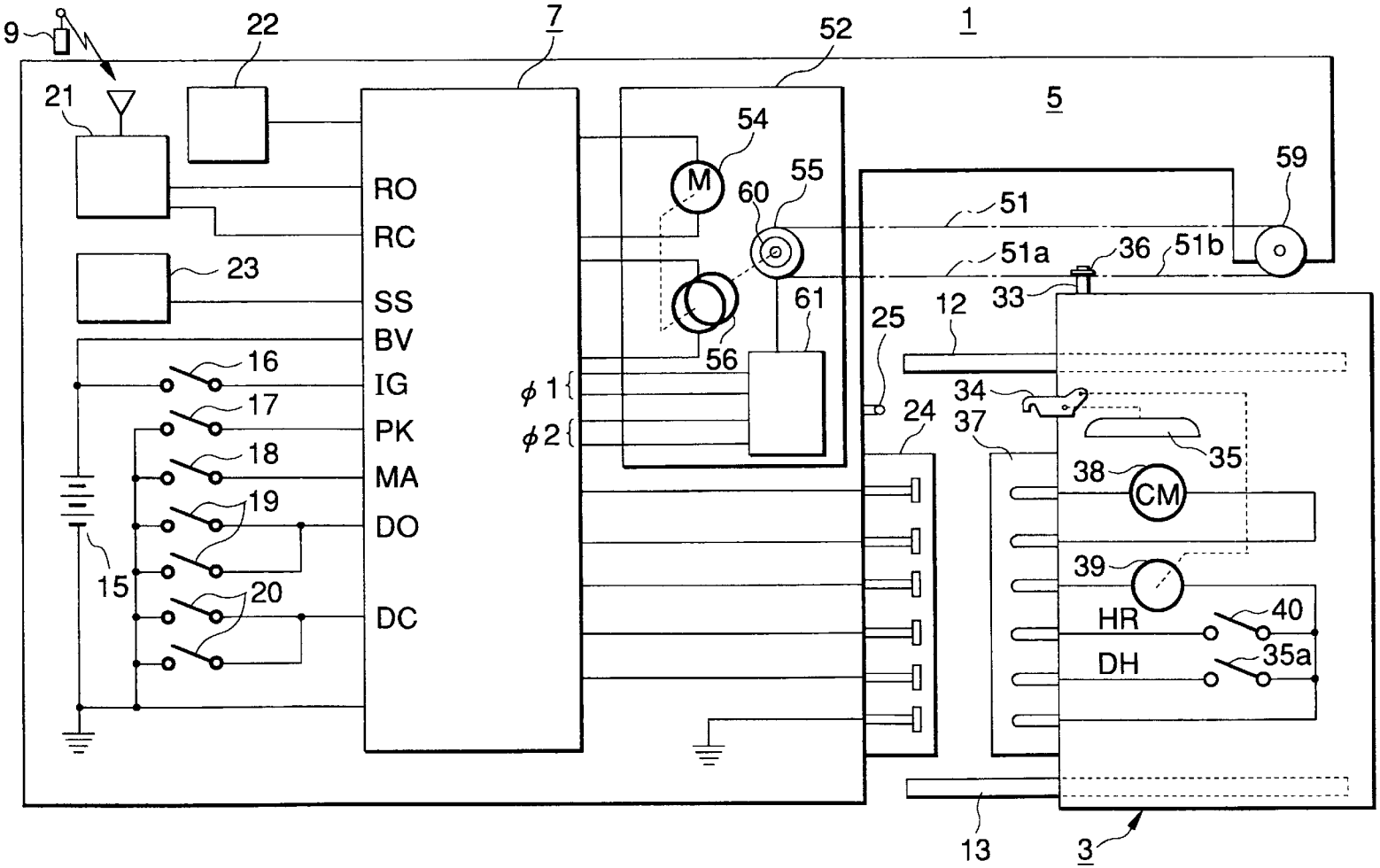
FIG. 8 is a block diagram showing a connection of a slide door control unit and its related electrical components.

The electrical connections of a slide door control unit 7 and the electrical components mounted on the vehicle body 1 and the slide door 3 will be described with reference to a block diagram shown in FIG. 8. The slide door control unit 7 is installed, for example, at a location near the drive means 52 in the vehicle body 1. The slide door control unit 7 controls the slide door drive mechanism 5, and uses a program control by a microcomputer for the control.

The electrical connections of the slide door control unit 7 to the electrical components in the vehicle body 1 are: it is connected to a battery 15 to receive a DC voltage BV therefrom, an ignition switch 16 to receive an ignition signal IG, a parking switch 17 to receive a parking signal PK, and a main switch 18 for receiving a main switch signal MA.

Further, the slide door control unit 7 is connected to a door opening switch 19 to receive a door open signal DO therefrom, a door closing switch 20 to receive a door close signal DC, a keyless system 21 to receive a remote open signal RO or a remote close signal RC from the wireless remote switch 9, a buzzer 22 for generating an alarm when the slide door 3 is automatically opened or closed, and a speed sensor 23 to receive a vehicle speed signal SS. The opening switch 19 and the closing switch 20 are each provided with two contacts as shown, for the reason that these switches are mounted at two locations, for example, the driver's seat and the rear seat.

The connections of the slide door control unit 7 to the slide door drive mechanism 5 are the connections for supplying electric power to the open/close motor 54, for controlling the electromagnetic clutch 56, and the connection with the pulse generator 61 which outputs pulse signals $\phi 1$ and $\phi 2$ by receiving pulse signals from the rotary encoder 60. The rotary encoder 60 and the pulse generator 61 make up movement detecting means.

The slide door control unit 7 is electrically connected to the electrical components in the slide door 3 when the vehicle connector 24 mounted at a position of the door opening portion 11 is connected to the door connector 37 mounted at the opening end of the slide door 3 in a state that the slide door 3 is slightly moved for opening from the closed position.

When the slide door control unit 7 is thus connected to the electrical components in the slide door 3, the following electrical connections are set up: the connection for supplying electrical power to the closure motor (M) 38 to tighten the slide door 3 being in a half-latch state to its full-latch state, the connection for supplying electric power to the actuator (ACTR) 39 to drive a door lock 34 out of a striker 25, the connection for detecting a half-latch to receive a half-latch signal HR from the half-latch switch 40, the connection for receiving a door handle signal DH from a door handle switch 35*a* to detect an operation of the door handle 35 coupled with the door look 34, and other connections.

Slide Door Control Unit

Figure 9:
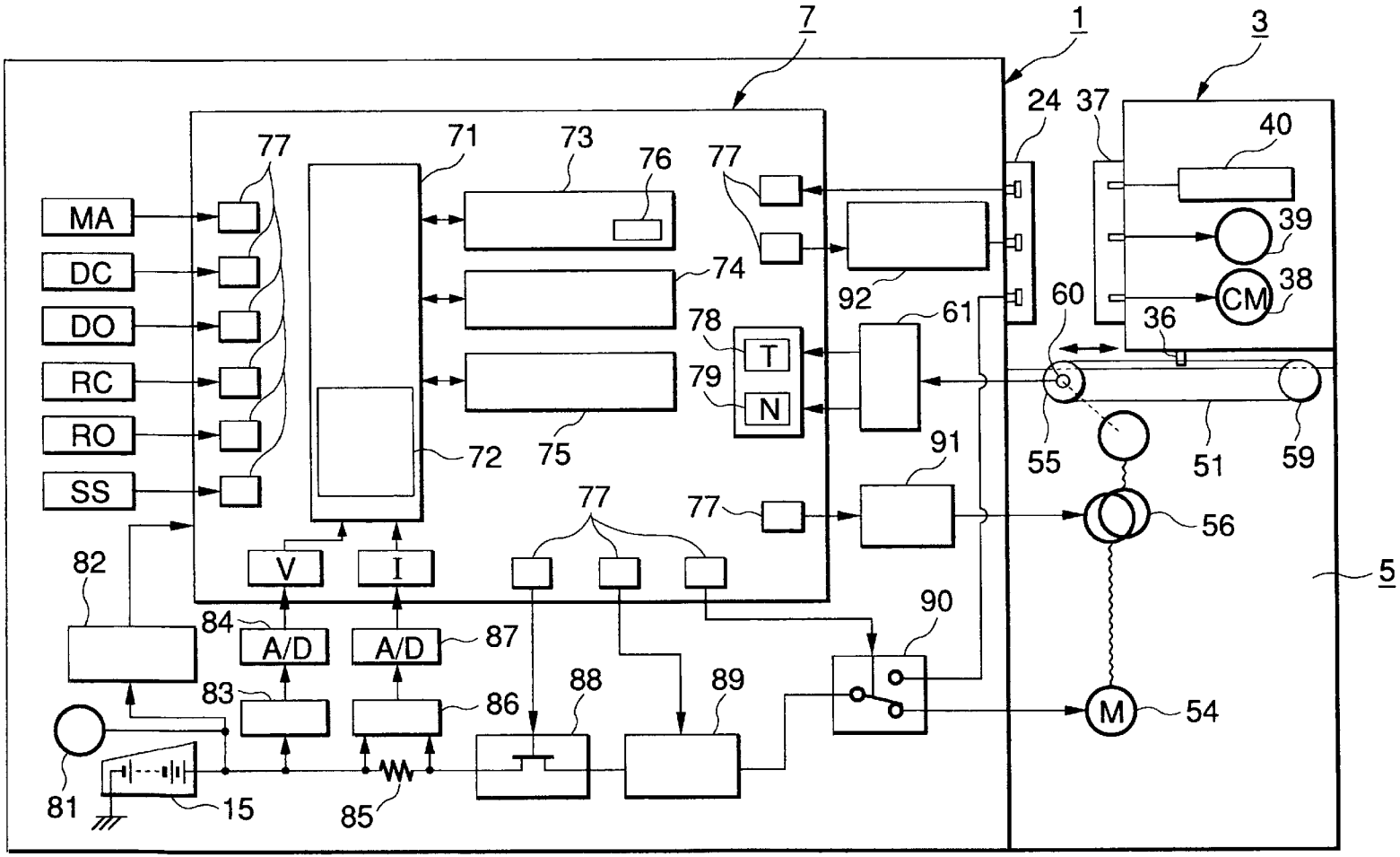
FIG. 9 is a block view showing a principal portion of the slide door control unit.

An arrangement of the slide door control unit 7 will be described with reference to a block diagram of FIG. 9. The slide door control unit 7 includes a main controller 71 and repeats its control at fixed periods of time. The main controller 71 contains a control mode selector 72 for selecting a proper control made according to the statuses of the peripheral circuits.

The control mode selector 72 selects the special purpose controller most suitable for the slide door control from among those controllers according to the latest statuses of the peripheral circuits. The special purpose controllers are an automatic slide controller 73, a speed controller 74 and a pitching controller 75. The automatic slide controller 73 controls mainly the opening and closing of the slide door 3. The speed controller 74 controls a moving speed of the moving slide door 3. The pitching controller 75 detects if an object obstructs the movement of the moving slide door 3. The automatic slide controller 73 includes a slope judging portion 76 for detecting an attitude of the vehicle body 1.

A plural number of input/output ports 77 serve as input/output ports for on/off signals for various switches already stated and an energizing/deenergizing signal for relays, clutches and the like. A speed calculating portion 78 and a position detecting portion 79 receive two-phase pulse signals ϕ1 and ϕ2 from the pulse generator 61, and generate a period count value T and a position count value N, which will be described later.

The battery 15 is charged by a dynamotor 81 when the vehicle runs, and the output voltage of the battery is stabilized into a constant voltage by a stabilizing power source circuit 82, and applied to the slide door control unit 7. The output voltage of the battery 15 is detected by a voltage detector 83, and converted into a digital signal by an A/D convertor 84. The digital signal is input to the main controller 71 of the slide door control unit 7.

The output voltage of the battery 15 is applied to a shunt resistor 85, and a current flowing through the shunt resistor 85 is detected by a current detector 86. A current I detected in converted into a digital signal by an A/D convertor 87, and the digital signal is input to the main controller 71 of the slide door control unit 7.

The output voltage of the battery 15 is applied to a power switch element 88 by way of the shunt resistor 85. The power switch element 88, which in on/off controlled by the elide door control unit 7, converts a DC signal into a pulse signal, and applies the converted pulse signal to the open/close motor 54 or the closure motor 38. A duty ratio of the pulse signal nay be controlled as desired.

The pulse signal derived from the power switch element 88 in applied to the open/close motor 54 and the closure motor 38 by way of a polarity reversing circuit 89 and a motor select circuit 90. The polarity reversing circuit 89 is provided for changing the turning direction of the open/close motor 54 or the closure motor 38. The polarity reversing circuit 89, together with the power switch element 88, forms a power supplying circuit.

The rotor select circuit 90 selects either the open/close motor 54 or the closure motor 38 in accordance with an instruction issued from the main controller 71. Those motors are both used for driving the slide door 3, but are not driven simultaneously. For this reason, drive power is selectively fed to the motors. A clutch drive circuit 91 and an actuator drive circuit 92 are further used. The clutch drive circuit 91 is for controlling the electromagnetic clutch 56 in accordance with an instruction issued from the main controller 71. The actuator drive circuit 92 is for controlling the actuator 39 in response to an instruction from the main controller 71.

Period Count Value T/ Position Count Value N)

Figure 10:
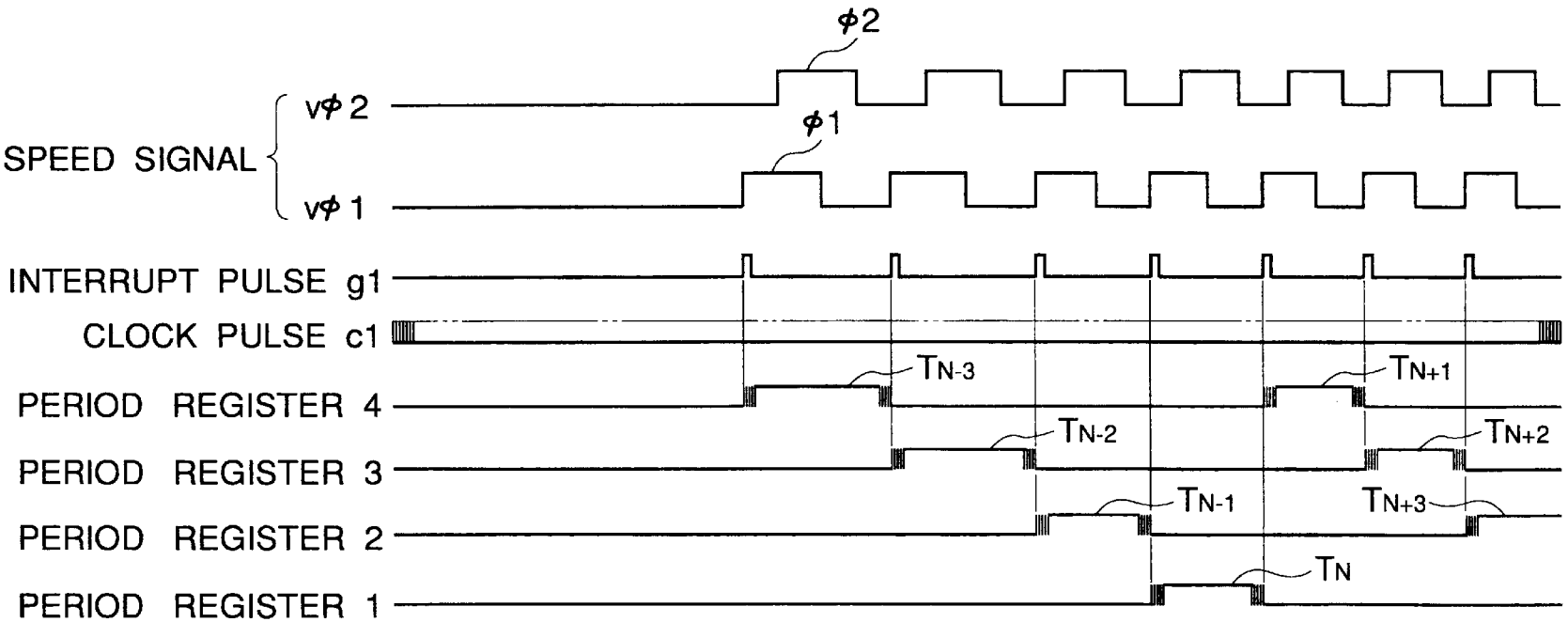
FIG. 10 is a timing chart for explaining an operation of a speed calculating portion.

FIG. 10 is a timing chart showing the operations of the speed calculating portion 78 and the position detecting portion 79. Two-phase pulse signals ϕ1 and ϕ2 are generated by the rotary encoder 60, and applied to the pulse generator 61, which in turn outputs them in the form of speed signals Vϕ1 and Vϕ2 for transmission to the speed calculating portion 78 and the position detecting portion 79.

The speed calculating portion 78 and the position detecting portion 79 detect a turning direction of the rotary encoder 60, that is, a moving direction of the slide door 3, on the basis of a phase relation of those speed signals. In an example, if the pule signal ϕ2 is in an L level (as illustrated) at the leading edge of the pulse signal ϕ1, it is judged that the slide door is moving in the opening direction. if the pulse signal ϕ2 is in an H level, it is judged that the slide door is moving in the closing direction.

The speed calculating portion 78 generates an interrupt pulse g1, and counts the number of clock pulses C1 during the repetition period of the interrupt pulse g1 and produces the resultant count as a period count value T. The repetition period of the clock pulses C1 is much shorter (e.g., 400 μsec) than that of the interrupt pule g1.

It in assumed that the rotary encoder 60 generates one pulse (one period) every 1 mm of the movement of the slide door 3. If the period count value T is 250, a moving speed of the slide door 3 is: 1 mm/(400 μs×250)=10 mm/sec. If the period count value T is 100, the moving speed of the slide door 3 is 25 mm/sec.

The subscripts N−3 to N+3 of the period count values TN−3 to TN+3 shown in the figure indicate position count values N−3 to N+3, which are representative of position information of the slide door 3, which are produced by counting position count pulses (substantially equal to the interrupt pulse g1) resulting from the pulse signal ϕ1 output from the rotary encoder 60. The period count value TN indicates the period count value T corresponding to the N-th position currently noticed. TN−1 and TN−2 indicate the period count values T at the 1st and 2nd positions preceding to the position count value N. and TN+1 and TN+2 indicate the period count values T of the 1st and 2nd positions subsequent to the position count value N.

The present embodiment is arranged such that the process of recognizing the sped of the slide door 3 commences at a value obtained by successively counting four periods of the speed signal Vϕ1. Four period registers 1 to 4 are provided for storing the count values of the four periods. The N-th positions an mark points are stored into the registers 1 to 4 so that those positions are starting output values of the registers.

Slide Door Located Areas

Figure 11:
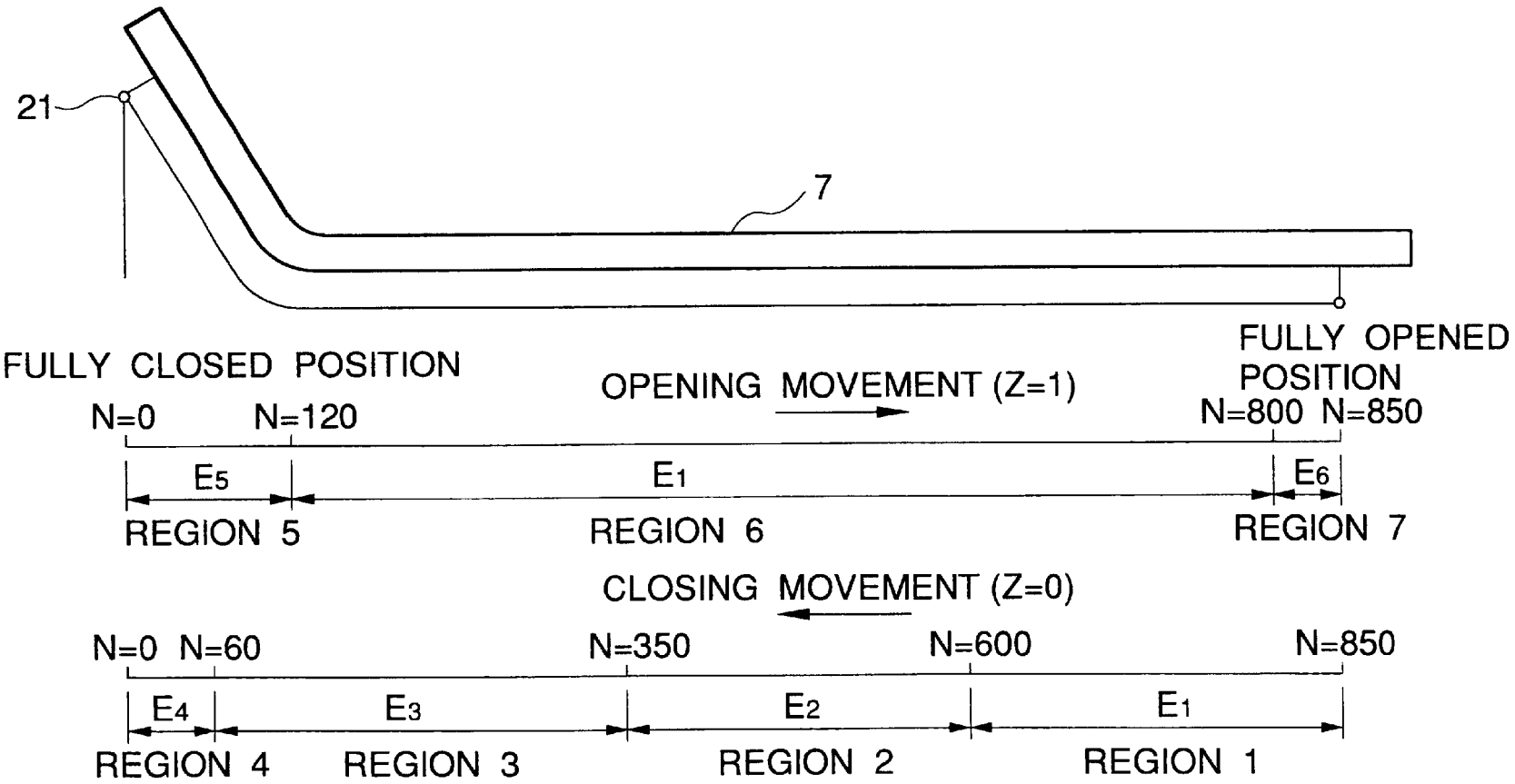
FIG. 11 is a plan view showing the lower track.

FIG. 11 is a plan view showing the guide track 14 useful in explaining areas on the guide track 14 where the slide door 3 in located. In the figure, a position of the slide door 3 is expressed in terms of a position of the moving member 36. The route of the slide door extended in the closing direction is segmented into four regions, regions 1 to 4, while the route extended in the opening direction is segmented into three regions, regions 5 to 7.

The position count value N is 0 at the fully closed position of the slide door 3, and 850 at the fully opened position. When Z=0 (in the closing movement of the slide door), the position count value N ranges from 850 to 600 (N=850 to 600) in the region 1; N=600 to 350 In the region 2; N=350 to 60 in the region 3; N=60 to 0 in the region 4. The half of the region 4 (closer to the fully closed position) is an ACTR region. When Z=1 (in the opening movement), N=0 to 120 in the region 5; N=120 to 800 in the region 6; N=800 to 850 in the region 7.

The regions 1 to 6 belong to a normal control region E1; the region 2 is a deceleration control region E2; the region 3 is a link deceleration region E3; the region 4 is a tightening control region E4; the region 5 is a link deceleration region E5; and the region 7 is a check control region E6. The slide door 3 is controlled at the moving speeds which are appropriately selected for those regions.

Main Routine

Figure 12:
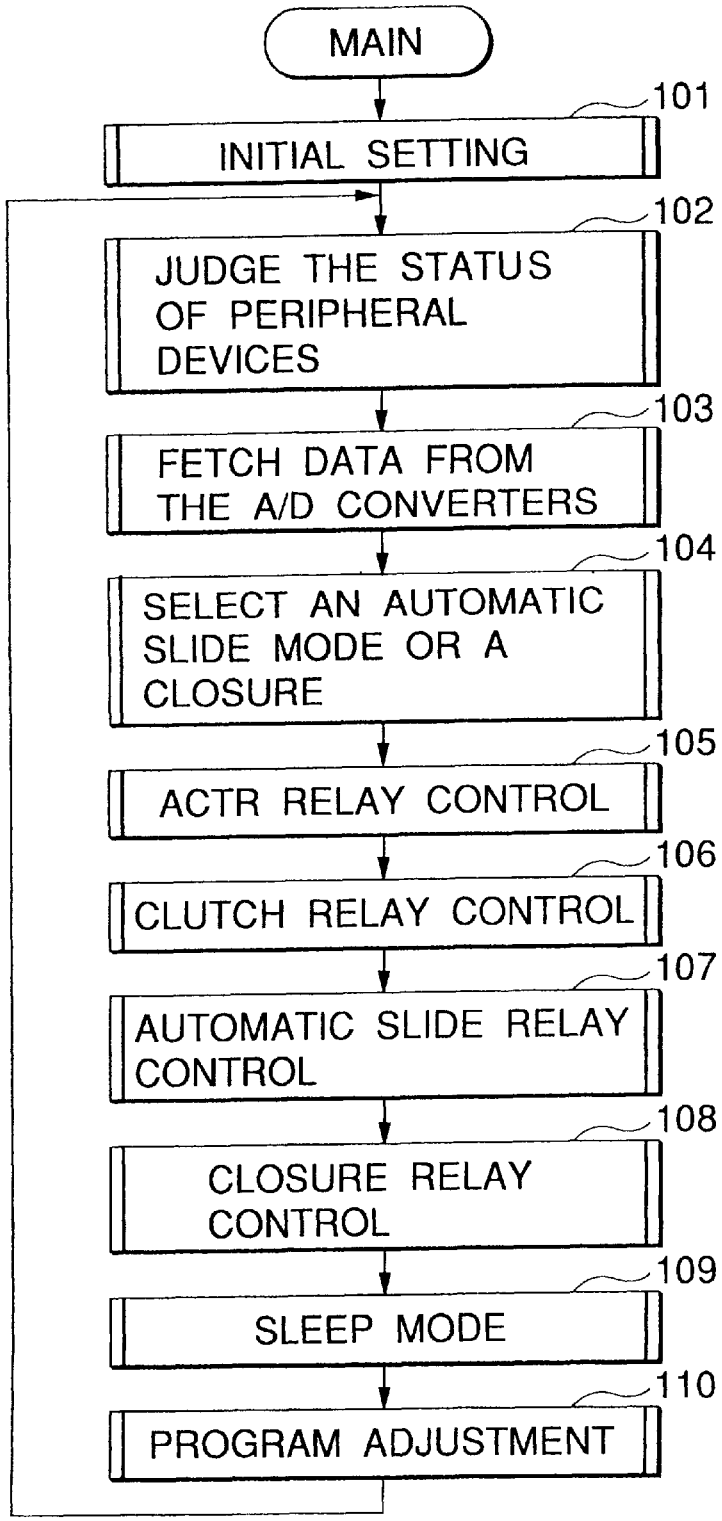
FIG. 12 is a flow chart showing a main routine for explaining an operation of the invention.

The operation of the door-holding control system for a vehicle slide door, which is thus constructed, will be described. FIG. 12 is a flow chart showing a main routine for explaining the operation of the slide door control unit 7. In this routine, at the start of the operation, an initial setting routine is executed (step 101) to initialize main parameters and others. A switch judging routine is carried out in a step 102. This routine fetches information on the statuses (on/off) of the switches 16 to 20 connected to the input/output ports 77, information from the keyless system 21, information and others from the speed sensor 23, and sets their flags, and loads data into the registers.

An A/D input task is carried out in a step 103. This step fetches a voltage value V and a current value I from the A/D convertors 84 and 87. A mode judging routine is executed on the basis of circumferential conditions, for example, on/off statuses of the switches (step 104). This routine has an automatic slide mode judging routine and a closure mode judging routine. Either of those routines is selected in use. In the automatic slide mode judging routine, the open/close motor 54 is driven to open and close the slide door 3. In the closure mode judging routine, the closure motor 38 in driven to tighten the slide door to the full latching, or to release the slide door from being latched.

An actuator (ACTR) relay control (step 105), clutch relay control (step 106), automatic slide relay control (step 107), and closure relay control (step 108) follow the mode judgement task. Those control tasks are concerned with the direct controls to supply electric power to the electromagnetic clutch 56, open/close motor 54, and closure motor 38 in accordance with the output signals from the various control portions, and hence, less elaboration on them will be given. The operations of starting and stopping the open/close motor 54 for opening and closing the slide door 3 are performed in the automatic slide relay control (step 107).

A sleep mode (step 109) carries out a power saving control when any change does not occur for a long time. A program adjustment is carried out in a step 110. In this step, a repetition interval of the main loop (steps 102 to 109) is set at a fixed value of time, e.g., 10 mmsec, by a program adjusting timer by an interrupt program provided separately from the main routine.

A control point in each step falls to a deeper level of the nest or gets off in a shallow level according to the circumferential conditions. That is, the repetition intervals returning to the entry point of the main loop vary. The program adjustment task adjusts such a variation of the repetition intervals to be constant by interrupting the main loop by the program adjusting timer. Following the program adjustment, control returns to the switch adjustment (step 102), and repeats the subsequent process steps, thereby to execute a loop control.

Automatic Slide Mode Adjustment

Figure 13:
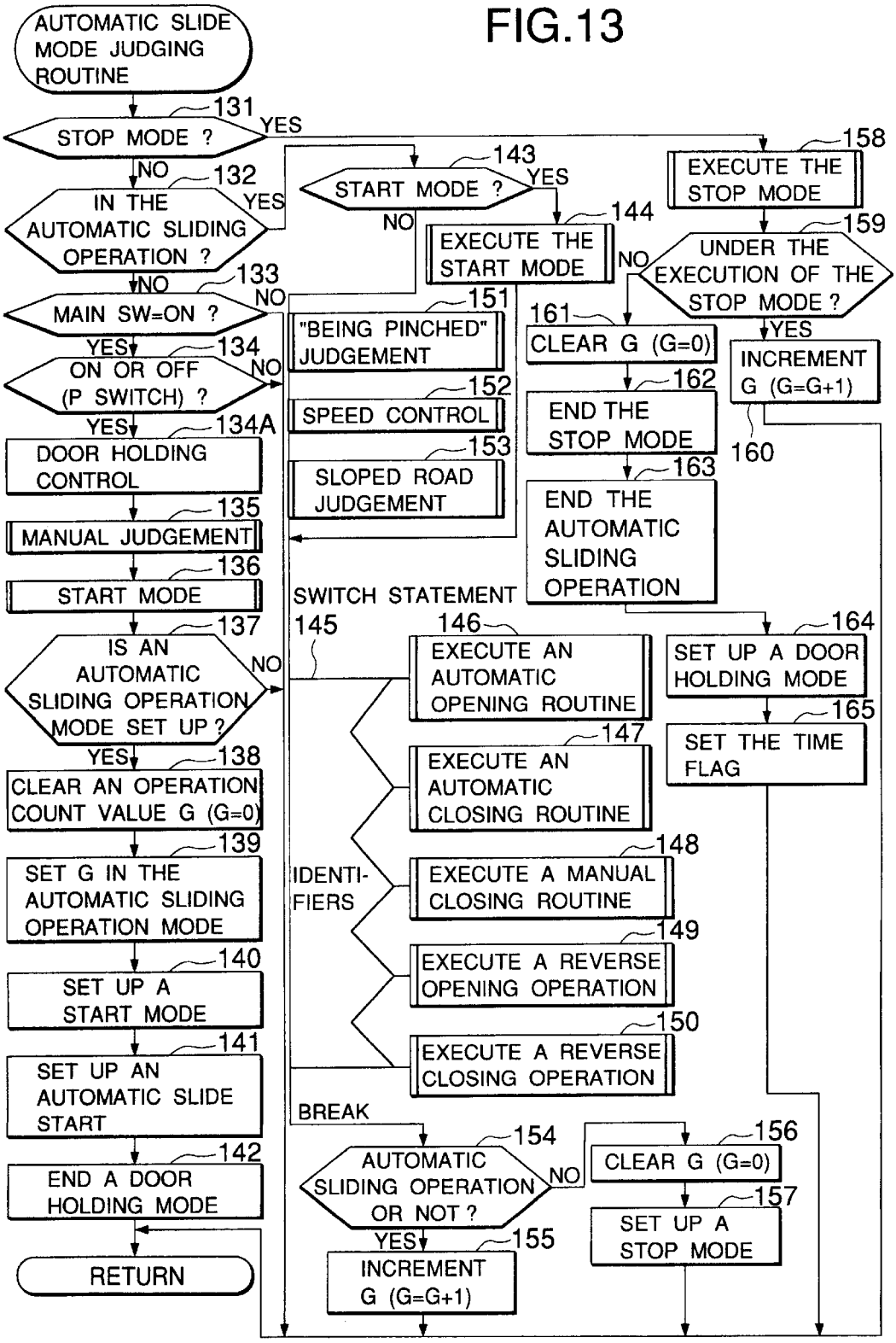
FIG. 13 is a flow chart showing an automatic slide mode judging routine.

FIG. 13 is a flow chart showing the details of the automatic slide mode judging routine in the mode judging routine (step 104). This routine judges various modes when the slide door 3 in driven for its opening and closing, and executes these modes on the basis of the results of the judgements. The routine first judges if the current mode is a stop mode (step 131). The stop mode is a mode which is set upon the end of an automatic slide mode and gives an instruction to stop the open/close motor 54 and to turn off the electromagnetic clutch 56. Therefore, in initial stage, it is not a stop mode.

Then, the routine judges if the automatic sliding operation progresses (step 132). Since the automatic sliding operation is not performed in the initial stage, the routine checks if the main switch 18 is turned on or off (step 133). If the main switch 18 is in an off state, the routine makes a return. If the main switch 18 is in an on state, the routine checks an on/off state of the parking switch (P switch) 17 (step 134). If the P switch 17 is in an off state, the routine makes a return. If the P switch 17 is in an on state, the routine executes a door holding control routine (to be described later) (step 134A), and successively executes a manual judging routine and a start mode judging routine (steps 135 and 136).

The manual judging routine (step 135) is a task which detects that an operator has moved the slide door 3 at over a predetermined speed, and sets up a manual opening state or a manual closing state in accordance with the moving direction, and thus prepares for the shift to the automatic slide mode.

The start mode judging routine (step 136) is a task which judges the start of the automatic sliding operation. When the switch judging routine (step 102) checks an on state of the opening switch 19 or the closing switch 20, when the wireless remote switch 9 designates the opening or closing of the door, or when the manual judging routine (step 135) confirms that the manual opening state or the manual closing state has been set up, the routing judges that the current mode is an automatic sliding operation mode. Also when a half-clutch control routine (to be described later) judges that the slide door is intentionally opened or closed, it is judged that the automatic sliding operation mode has been set up.

When the start mode judging routine (step 136) ends, the routine judges if the current mode is the automatic sliding operation mode (step 137). If it is not the automatic sliding operation mode, the routine makes a return. If it in not the automatic sliding operation mode, the routine executes the following tasks to start the automatic sliding operations it clears an operation count value G (step 138), sets it during the automatic sliding operation (step 139), note up a start mode (step 140), and sets up an automatic slide start (step 141), and ends the door holding mode (step 142).

Where the automatic sliding operation start is thus set up, the next automatic slide mode judging routine judges that the automatic sliding operation progresses (step 132) and the current mode is the start mode (step 143), and executes the start mode task (step 144). This start mode recognizes a mode to start the automatic sliding operation to drive the slide door 3 on the basis of the on/off states of the switches and other circumferential conditions, and performs the start control in the recognized node. The details of this will be described later.

When the start mode task is completed and the start mode is removed, in the next automatic slide mode judging routine, the automatic sliding operation progresses, and this routine executes the following tasks selected, through a switch statement 145, by identifiers set according to the on/off states of the switches: an automatic opening operation (step 146), an automatic closing operation (step 147), and a manual closing operation (step 148). When something is pinched in the door (this situation will be referred frequently to as "being pinched") during any of those operations, a reverse opening operation (step 149) or a reverse closing operation (step 150) is executed. Further, a pinch judging task (step 151), a speed control task (step 152), and a sloped road judging task (step 153) are successively executed.

During the automatic sliding operation, the routine increments the operation count value G (steps 154 and 155), and makes a return. When the automatic sliding operation ends, the routine clears the operation count value G (step 156), and sets up the stop mode (step 157), and makes a return.

If the stop mode is set up, the next automatic slide mode judging routine that the current mode is a stop mode (step 131), and executes the stop mode (step 158). The stop mode is provided for achieving a safety when the driving of the slide door 3 is stopped during the control of the opening or closing of the slide door 3 during the automatic sliding operation is controlled. In this mode, the timings of the declutching of the electromagnetic clutch 56 and the stopping of the open/close motor 54 are controlled. For example, when the slide door 3 is stopped at a mid position, the open/close motor 54 is first stopped, and after a time lag the electromagnetic clutch 56 is declutched. When slide door 3 is stopped at the fully cloned position, the stopping of the open/close motor 54 and the declutching of the electromagnetic clutch 56 are simultaneously performed.

During the execution of the stop mode (step 159), the routine increments the operation count value G (step 160), and makes a return. When the stop mode ends, the routine clears the operation count value G (step 161), removes the stop mode (step 162), terminates the automatic sliding operation (step 163), sets up the door holding mode (step 164), and sets a time flag (step 165), and makes a return.

Start Mode Routine

FIG. 14 is a flow chart showing the details of the start mode routine (step 144). This routine is a task to select a start mode to start the movement of the slide door 3 on the basis of the on/off states of the switches and other circumferential conditions, and starts the movement of the slide door 3.

The routine first judges if start identifiers are set (in step 171). If it is not set, the routine judges it the current mode is a manual mode (step 172). If the manual judging routine (step 135) has recognized that the slide door 3 is in a manually opening state or a manually closing state, the routine judges that the current mode is a manual mode. The routine checks if the door is opened from the fully closed position (step 173). If the answer is YES, the routine sets up a manual fully-closing start mode (step 174), If it is NO, the routine sets up a manual normal start mode (step 175) and removes the manual mode (step 176).

If the current mode is not the manual mode, the routine checks if the door opening operation progresses (step 177). If the door opening operation progresses and the door is in the ACTR control region (step 178), the routine sets up an ACTR start mode (step 179). If the door closing operation progresses or the door opening operation progresses but the door is not in the ACTR control region, the routine sets up a normal start mode (step 180). In this way, the identifiers for the respective start modes are set, and then the routine clears the operation count value G (step 181) and makes a return. The setting conditions for the start modes are:

Normal start mode: The door movement in started by the switch operation except when the door is fully closed.

ACTR start mode: It in started by the switch operation when the door is fully closed.

Manual normal start mode: It is started by manual operation except when the door is fully closed.

Manual fully-closed start mode: It is started by manual operation when the door is fully closed.

In this way, the identifiers for the respective start modes are set, and a start mode is selected by the next routine. Now, the start identifiers have been set (step 171), and then the start mode routine selectively executes a normal start mode (step 183), an ACTR start mode (step 184), the manual normal start mode (step 185), and the manual fully-closed start mode (step 186), according to the start identifiers (step 192).

The normal start mode is for controlling the door movement at its start in other regions than the fully closed region. In this mode, the electromagnetic clutch 56 is first turned on to set up the connection of the open/close motor 54 and the drive pulley 55. Thereafter, after an ON time lag of the electromagnetic clutch 56, the door is get to be automatically slidable, and the open/close motor 54 is driven. When the open/close motor 54 starts up, the start identifiers are reset to remove the start mode (steps 187 and 188), and the operation count value G is cleared (step 189).

The ACTR start mode disengages the door lock latch 34 from the striker 25 through the ACTR 39 and controls the door movement at its start, In this mode, after an off state of the half-latch switch 40 is confirmed, the electromagnetic clutch 56 is turned on. After the ON time lag of the electromagnetic clutch 56 elapses, the door is set to be automatically slidable. Thereafter, when the open/close motor 54 is in an on state, the routine resets the start identifiers, and executes the steps 187 to 189, and informs other routines of the end of the start control.

The manual normal start mode sets a motor drive voltage at such a value as to move the slide door 3 at a predetermined speed, and determines the polarity of the motor drive voltage in accordance with the direction in which the slide door 3 is moved for its opening or closing. After a preset time elapses, the electromagnetic clutch 56 in turned on to move the slide door 3. Thereafter, the routine executes the steps 187 to 189, and informs other routines of the end of the start control. When a speed of the slide door 3 manually moved is higher than that of the slide door when it is rapidly moved, the door is moved at its high speed for the priority of the mannual operation. Therefore, the electromagnetic clutch 56 is not turned on and the open/close motor 54 is stopped. Also when the moving speed of the door 3 is lower than a manual recognition speed, the routine is not shifted to the automatic mode. Therefore, the electromagnetic clutch 56 is not turned on and the open/close motor 54 is stopped.

The manual fully-closed start mode moves the slide door 3 at a predetermined speed in the opening direction. Therefore, the routine sets the polarity of the motor drive voltage and the voltage value so that the door is so moved, and turns on the electromagnetic clutch 56 and drives the slide door 3. Thereafter, the routine executes the tasks of the steps 187 to 189, and informs other routines of the end of the start control.

Automatic Opening Routine

Figure 15:
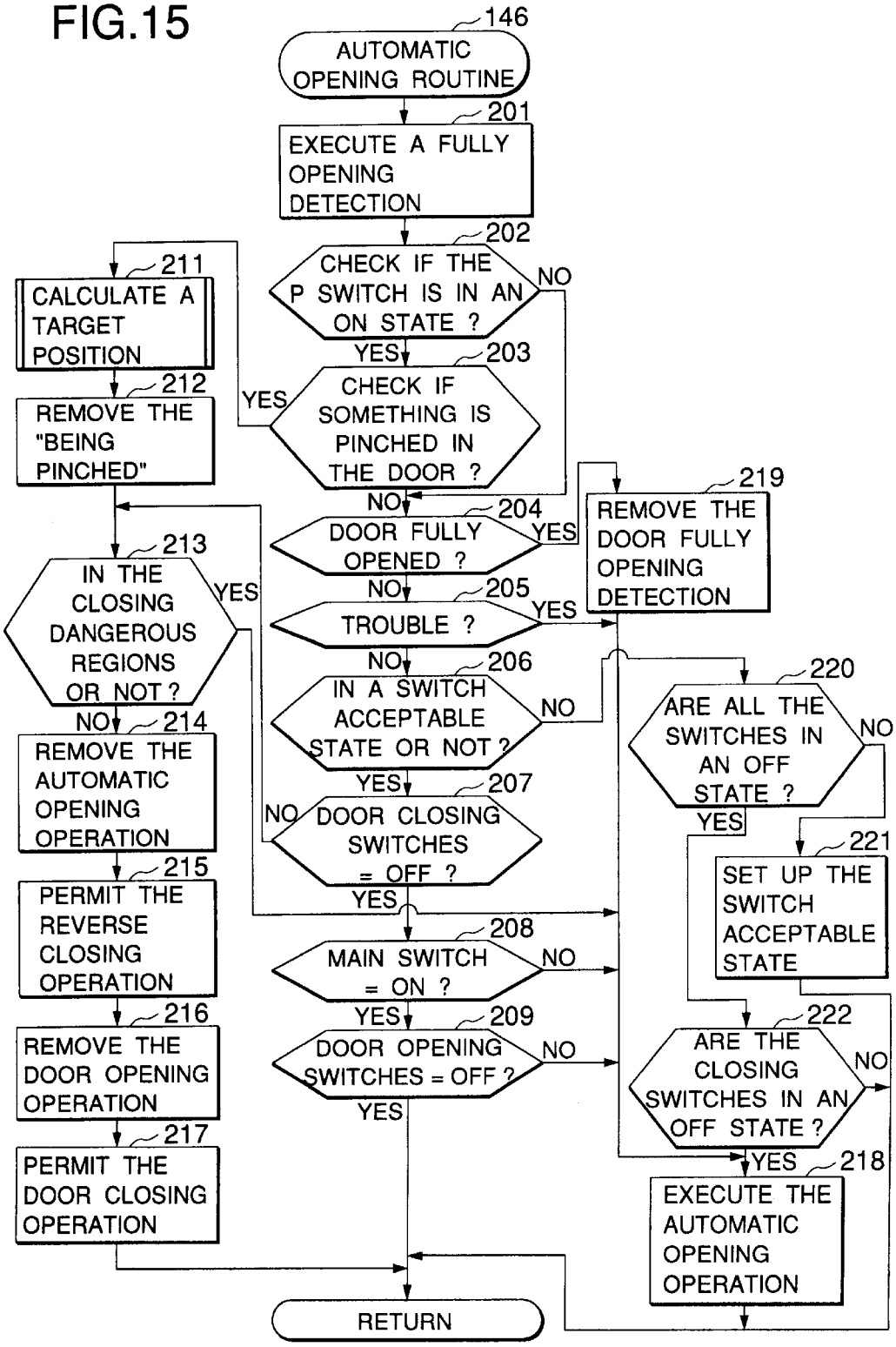
FIG. 15 is a flow chart showing an automatic opening routine.

FIG. 15 is a flow chart showing the details of the automatic opening routine (step 146). When the wireless remote switch 9 is operated for opening the slide door 3, when the opening switch 19 is turned on, or when it is confirmed that the door is manually opened, the automatic opening routine is selected by a switch statement 145, and the routine controls the driving, the stopping or the reversing operations of the slide door 3 in order to safely drive the slide door 3 in the is opening direction.

The automatic opening routine first executes a fully opening detection (step 201) to check if the slide door 3 reaches a fully opened position. Then, the routine checks if the P switch 17 is in an on state (step 202). If the P switch 17 is in an on state, the routine checks if something is pinched in the door (step 203). If nothing is pinched, the routine checks if the step 201 detects that the slide door 3 has reached the fully opened position (step 204). If the P switch 17 is not in an on state (step 202), the routine jumps the step 203 and executes a step 204. In this step, the routine checks if the slide door 3 is fully opened.

The automatic opening routine makes a return in order to continue the automatic sliding operation, if the slide door 3 is not fully opened (step 204), no trouble occurs (step 205), the switch acceptable state is set up (step 206), the door closing switches are both in an off state (step 207), the main switch 18 is in an on state (step 208), and the door opening switches are both in an off state (step 209).

When the "being pinched" is detected (step 203), a target position is calculated (step 211) to reverse the direction of the moving door 3 and stop the door. The routine removes the "being pinched" (step 212), and removes the automatic opening operation (step 214) unless the door is located in any of the closing dangerous regions (regions 2 to 4). further, the routine permits the reverse closing operation (step 215), removes the door opening operation (step 216), permits the door closing operation (step 217), and makes a return. If the door is located in the closing dangerous regions (step 213), the routine executes the automatic opening operation removal (step 218). If the automatic opening operation removal is executed, the stop mode is set up (step 157). Through the clutch relay control (step 106) and the automatic slide relay control (step 107) in the stop mode (step 158) are carried out to turn off the electromagnetic clutch 56. The open/close motor 54 is stopped and the automatic door moving operation is removed.

If the slide door 3 reaches the fully opened position (step 204), the automatic opening routine removes the door fully opening detection (step 219), and executes the automatic opening operation removal (step 218). The routine executes the automatic opening operation removal (step 218) also when a trouble, e.g., a door locking, is detected (step 205), and the main switch 18 is turned off (step 208).

In the present embodiment, all the opening and closing switches are of the push-on/push-off type. When the opening switches are both left on, the routine judges that a switch acceptable state is not set up (step 206), and checks the on/off states of the switches. If the result shows that all the switches are in an off state (step 220), the routine sets up the switch acceptable state (step 221), and makes a return.

When either of the opening switches is in an on state (step 220) while either of the closing switches is in an off state (step 222), the routine makes a return and continues the automatic opening operation. When either of the opening switches is in an on state (step 220) and either of the closing switches are also in an on state (step 222), the routine executes the automatic opening operation removal (step 218) since both the opening switches and the closing switches are in an on state.

If a switch acceptable state is set up (step 206), viz., all the opening and closing switches are in an off state, and it either of the closing switches is turned on (step 207), the routine judges that a door closing instruction is issued, and executes the step 213 and the subsequent ones. If either of the opening switches Is turned on (step 209), the opening switches of the push-on/push-off type are turned on again, and therefore, the routine executes the automatic opening operation removal (step 218).

Automatic Closing Routine

Figure 16:
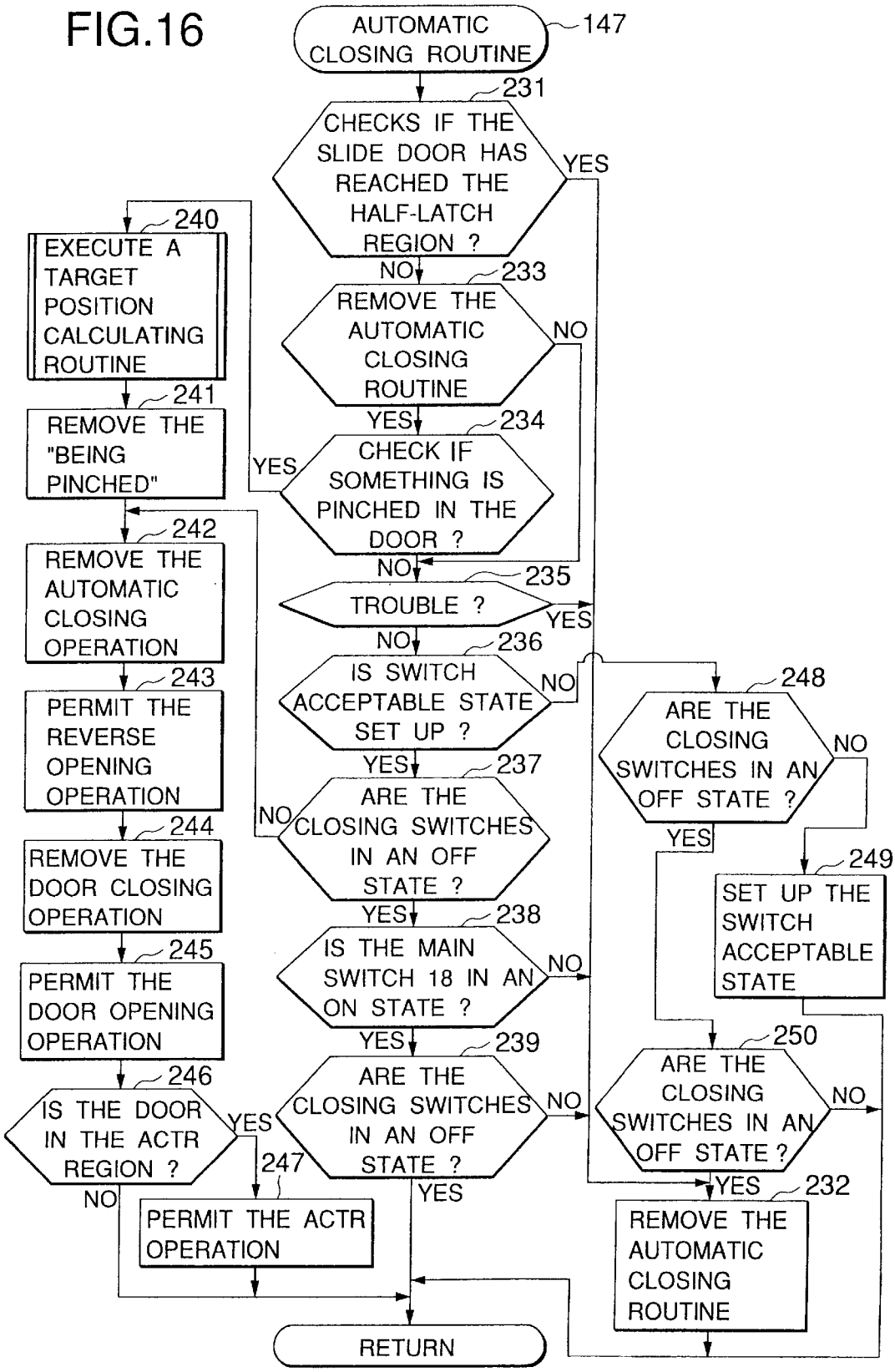
FIG. 16 is a flow chart showing an automatic closing routine.

FIG. 16 is a flow chart showing an automatic closing routine (step 147, FIG. 13). When the wireless remote switch 9 is operated for closing the slide door 3 in the regions of the door sliding routs other than the dangerous regions, when the closing switch 20 is turned on, or when it is confirmed that the door is manually closed, the automatic closing routine is selected by a switch statement 145, and the routine controls the driving, the stopping or the reversing operations of the slide door 3 in order to safely drive the slide door 3 in the closing direction.

The automatic closing routine first checks if the slide door 3 has reached the half-latch region (step 231). If it has reached there, the routine removes the automatic closing routine (step 232) since the object is achieved. When the automatic closing routine is removed, the stop mode is met up (step 157). Through the clutch relay control (step 106) and the automatic slide relay control (step 107) in the stop mode (step 158) are carried out to turn off the electromagnetic clutch 56. The open/close motor 54 is stopped and the automatic door moving operation in removed.

If it has not reached there, the routine checks if the P switch 17 is in an on state (step 233). If the P switch 17 is in an on state, the pinch judging routine (step 151) checks it something is pinched in the door (step 234). If the P switch 17 is not in an on state, the routine jumps a step 234.

Then, the routine makes a return to continue the automatic closing operation if the switch acceptable state is set up (step 236), the closing switches are both in an off state (step 237), the main switch 18 is in an on state (step 238), and the closing switches are both in an off state (step 239).

If the "being pinched" is detected (step 234), the routine executes a target position calculating routine (step 240) to reverse the moving direction of the slide door 3 to the opening direction and stop the movement of the slide door. Further, the routine removes the "being pinched" (step 241), removes the automatic closing operation (step 242), permits the reverse opening operation (step 243), removes the door closing operation (step 244), and permits the door opening operation (step 245). It the door 3 is not in the ACTR region, the routine makes a return. If it is in the ACTR region (step 246), the routine permits the ACTR operation (step 247) and makes a return.

When an abnormal current (e.g., motor locking) is detected (step 235), or when the main switch 18 is turned off (step 238), the routine executes the automatic opening operation removal routine (step 232).

If the routine judges that the switch acceptable state is not set up while the opening and closing switches are left on (step 236), the routine checks the on/off states of the opening and closing switches. If the closing switches are both in an off state (step 248), the routine sets up the switch acceptable state (step 249), and makes a return.

If either of the closing switches is in an on state (step 248) and either of the opening twitches is in an off state (step 250), the routine makes a return and continues to the automatic closing operation. If either of the closing switches is in an on state (step 248) and either of the opening switches is in an on state, the routine executes the automatic closing operation removal (step 232) since the closing and opening switches are both in an on state.

If the switch acceptable state is set up (step 236) and either of the closing switches are turned on (step 237), the routine judges that an instruction of the door opening operation is issued, and executes the task (already stated) from the step 242 and the subsequent ones. If either of the closing switches is turned on (step 239), the routine executes the automatic closing operation removal (step 232) to stop the slide door 3 since the closing switch of the push-on/push-off type is turned on again.

Manual Closing Routine

Figure 17:
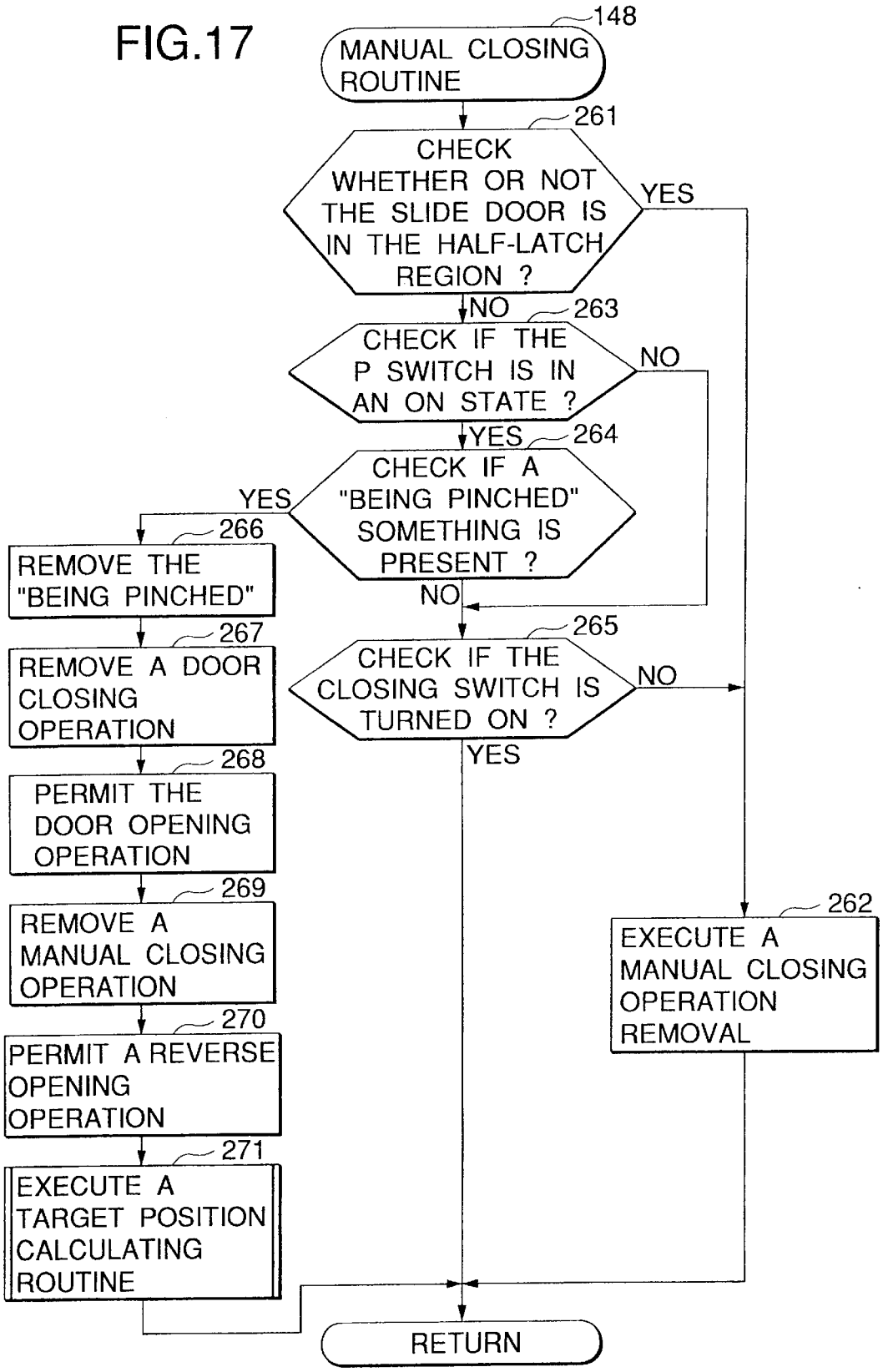
FIG. 17 is a flow chart showing a manual closing routine.

FIG. 17 is a flow chart showing the details of the manual closing routine (step 149, FIG. 13). After it is confirmed that the closing switch 20 is turned on in the dangerous regions (regions 2 to 4) is confirmed, the manual closing routine is selected by the switch statement 145. This routine operates to allow the closing operation only when an operator depresses the closing switch 20, and is removed when the operator releases the closing switch 20.

The manual closing routine first checks whether or not the slide door 3 is in the half-latch region (step 261). If the slide door 3 is in the half-latch region, the routine executes a manual closing operation removal (step 262). If the routine executes a manual closing operation removal, the stop mode is set up (step 157). Through the clutch relay control (step 106) and the automatic slide relay control (step 107) in the stop mode (step 158) are carried out to turn off the electromagnetic clutch 56. The open/close motor 54 is stopped and the automatic door moving operation is removed.

If the elide door 3 is not in the half-latch region, the routine checks if the P switch 17 is in an on state (step 263). If the P switch 17 is in an on state, the pinch judging routine (step 151) checks if something is pinched in the door (step 264). If nothing is pinched, the routine checks if the closing switch 20 is turned on (step 265). If it is turned on, the routine makes a return to continue the manual closing operation. If the closing switch 20 is not turned on, the routine executes the manual closing operation removal (step 262). If the P switch 17 is not turned on, the routine jumps the step 264.

If something is pinched (step 264), the routine removes a "being pinched" (step 256) to reverse the moving direction of the slide door 3 to the opening direction and to stop the door, removes a door closing operation (step 267), permits the door opening operation (step 268), removes a manual closing operation (step 269), permits a reverse opening operation (step 270), executes a target position calculating routine (step 271), and makes a return.

Target Position Calculating Routine

Figure 18:
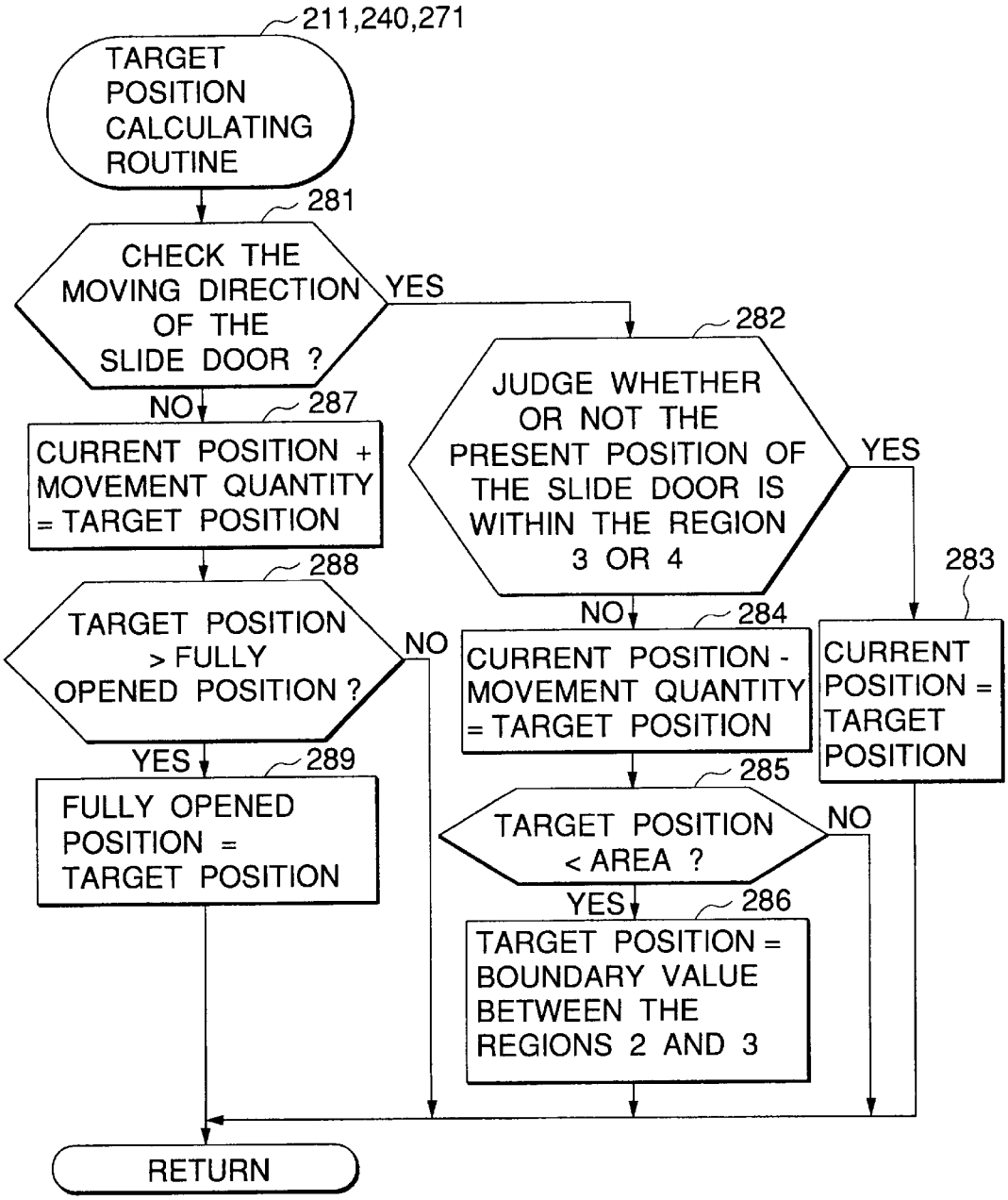
FIG. 18 is a flow chart showing a target position calculating routine.

FIG. 18 is a flow chart showing the details of the target position calculating routine (steps 211, 240, 271). In the automatic opening operation, the automatic closing operation, or the manual closing operation, when a "being pinched" is detected, the slide door 3 is reversed in its moving direction and moved to a safe position. In this case, it is necessary to determine a target position to which the slide door 3 is to be moved. The target position calculating routine is used for calculating the target position.

The target position calculating routine first checks the moving direction of the slide door 3 (step 281). If the slide door 3 is moving in the opening direction, the routine judges whether or not the present position of the slide door 3 is within the regions 3 and 4, by using a position count value N (step 282). If the slide door 3 is located within the regions 3 and 4, the routine uses the current position of the slide door 3 an a target position (step 283). When something is pinched in the door during the opening operation, and the door is reversed in its moving direction and moved in the closing direction, there is a danger that something is again pinched in the door. For this reason, when something is pinched, the slide door 3 is inhibited from being moved in the closing direction in the regions 3 and 4.

When the present position of the slide door 3 is out of the regions 3 and 4 (step 282), the routine subtracts a preselected quantity of the movement from the present position indicated by the position count value N, and uses the subtraction result as a target position (step 284). If the target position lies within the dangerous region whose region number is smaller than 3 (step 285), a boundary value (N=350) between the regions 2 and 3 is used as a target position (step 286).

If the slide door 3 is moving in the closing direction (step 281), a preselected quantity of the movement is added to the present position indicated by the position count value N, and the result of the addition is used as a target position (step 287). When the target position value is in excess of the fully opened position value (N=850) (step 288), the fully opened position is used as a target position (step 289).

Reverse Opening Routine

FIG. 19 is a flow chart showing the details of the reverse opening routine (step 149 in FIG. 13). This routine is selected by the switch statement 145 when the "being pinched" is present during the automatic closing operation or the manual closing operation. The routine reverses the moving direction of the slide door 3 and moves the door to a target position calculated by the target position calculating routine (step 240, 271), to thereby safely control the stopping of the door 3 and the reversing of the door movement direction.

The reverse opening routine first checks if the P switch 17 is in an on state (step 301). If it is not in an on state, the shift lever is not at the parking position or the vehicle is moving. In this case, therefore, this routine immediately removes a reverse opening operation (step 302), and makes a return. Then, a stop mode is set up (step 157), and through the clutch relay control (step 106) and the automatic slide relay control (step 107) in the stop mode (step 158) are carried out to turn off the electromagnetic clutch 56. The open/close motor 54 is stopped and the automatic door moving operation is removed.

If the P switch 17 is in an on state, the routine executes a door fully opening detection (step 303), and checks if the present position of the slide door 3 obtained from the position count value N reaches a target position (step 304). The routine makes a return to continue the reverse opening operation if the slide door 3 is not at the target position, the main switch 18 is in an on state (step 305), the slide door 3 is not at a fully opened position (step 306), no "being pinched" is present (step 307), no trouble is present (step 308), the switch acceptable state is set up (step 309), and the closing switches are both in an off (step 310).

When the slide door 3 reaches the target position (step 304) or the main switch 18 is turned off (step 305), the routine executes the reverse opening operation removal (step 302). When the slide door 3 reaches the fully opened position (step 306), the routine removes the door fully opening detection (step 311). If the "being pinched" is detected (step 307), the routine removes the "being pinched" detection (step 312). If a motor locking, for example, is detected (step 308) the routine removes an abnormal state detection (step 313). After each of those removals, the routine executes the reverse opening operation removal (step 302).

When either of the closing switches is turned on in a switch acceptable state (step 310), the routine judges that a door closing instruction has been issued and executes the reverse opening operation removal (step 302). If the switch acceptable state is not set up (step 309), the routine checks the on/off state of each opening/closing switch; if the opening/closing switches are all in an off state (step 314), the routine sets up the switch acceptable state (step 315); if either of the opening/closing switches is in an on state, the routine makes a return without any action. The reason for this follows. It is for this reason that when something is pinched in the door during the manual closing operation and the door is reversed in its moving direction and moves in the opening direction, the closing switch 20 sometimes is under depression. Even under depression of the closing switch, it is necessary to continue this mode.

Reverse Closing in Routine

Figure 20:
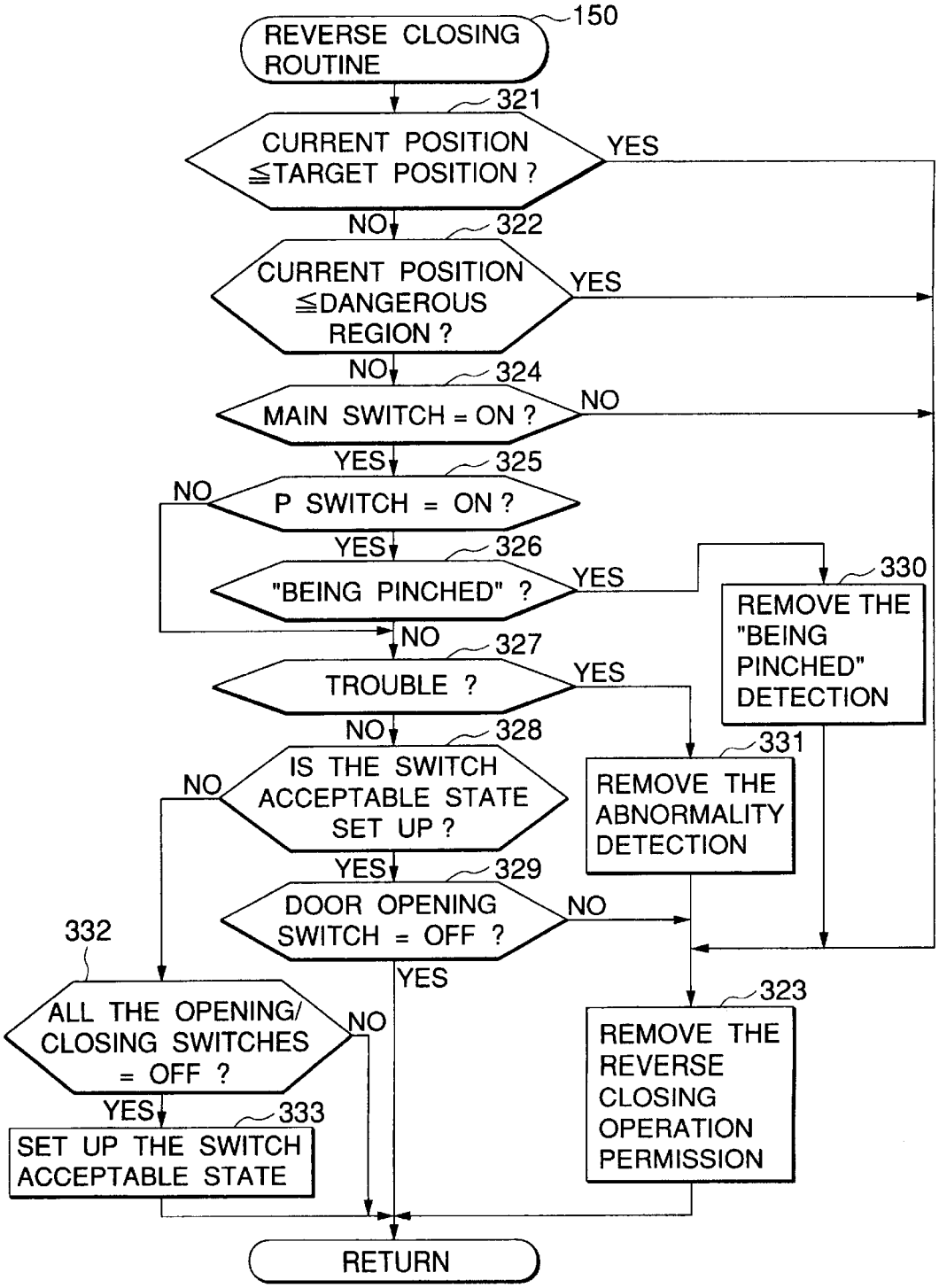
FIG. 20 is a flow chart showing a reverse closing routine.

FIG. 20 is a flow chart showing the details of the reverse closing routine (step 150). This routine is selected by the switch statement 145 when the "being pinched" is present during the automatic closing operation. The routine reverses the moving direction of the slide door 3 and moves the door to a target position calculated by the target position calculating routine (step 211) to thereby safely control the stopping of the door 3 and the reversing of the door movement direction.

Firstly, the reverse closing routine judges whether the current position of the slide door 3 in at the target position or in the dangerous regions (steps 321 and 322). If the door 3 is either at the target position or in the dangerous regions, the routine removes the door reverse closing operation (step 323). Then, a stop mode is set up (step 157), and through the clutch relay control (step 106) and the automatic slide relay control (step 107) in the stop mode (step 158) are carried out to turn off the electromagnetic clutch 56. The open/close motor 54 is stopped and the automatic door moving operation is removed.

The reverse closing routine makes a return in order to continue the reverse closing operation it the door 3 is neither at the target position nor in the dangerous regions, the main switch 18 (step 324), the P switch 17 is in an on state (step 325), no "being pinched" is present (step 326), no trouble occurs (step 327), the switch acceptable state is set up (step 328), and the opening switches are both in an off state (step 329).

When the main switch 18 in turned off (step 324), the routine executes the reverse closing operation removal (step 323). If the P switch 17 is in an off state (step 325), the routine jumps a step 326. When a "being pinched" is detected, the routine removes the "being pinched" detection (steps 326, 330). When a motor locking, for example, is detected, the routine removes the abnormality detection (steps 327, 331). Following each of those removals, the routine the reverse closing operation removal (step 323).

If the switch acceptable state is not set up (step 328), the routine checks the on/off state of the opening/closing switches. If those switches are all in an off state (step 332), the routine sots up the switch acceptable state (step 333). If any of the switches is in an on state, the routine makes a return without any action. The reason for this follows. It is for this reason that when something is pinched in the door during the automatic closing operation and the door is reversed in its moving direction and moves in the opening direction, the opening switch 19 sometimes in under depression. Even under depression of the closing switch, it is necessary to continue this mode. If either of the opening switches is turned on in an switch acceptable state (step 329), the routine judges that an instruction to open the door is issued, and executes the reverse closing operation removal (step 323).

Door Holding Control Routine

FIG. 21 is a flow chart showing the details of the door hold control routine (step 134A). This routine is for a mode in which the slide door 3 is held in a half-clutch state by such a transmission maintenance force as to prevent the slide door 3 from moving by its weight. The routine is set, together with a time lag flag, upon the end of the automatic sliding operation, as already stated (steps 164, 165).

To start, the routine checks if the current mode is a door holding mode (step 341). In the initial stage, the door holding mode is set up (step 342). Then, the routine checks if a time lag counter TF contains a count in excess of a preset value (step 343). Also in the initial stage, the count of the counter is below the preset value, to that the counting of the time lag counter TF continues (step 344).

When the count of the time lag counter TF exceeds the preset value, the routine removes the time lag flag (step 345), and resets the time lag counter TF (step 347). The tasks thus far made are carried out for the following reason. Immediately after the slide door 3 in stopped, there is a possibility that pulses are generated by, for example, a tension of the mechanical structure. Therefore, the system operation is rendered standstill.

In the next door holding control routine, the time lag flag is removed (step 342) and a pulse counter timer flag is set (step 348). Therefore, the pulses are counted till a pulse count timer TF reaches a preset value (steps 349 to 351). When a count of the pulse count timer TF reaches the preset value (step 349), the routine removes the pulse count flag (step 352) and resets the pulse count tinter TF (step 353).

When the counting of pulses in continued for a preset time, the routine checks if a holding force adjustment flag is set in the next door holding control (step 354). In an early stage it is not set, and then the routine monitors the generation of pulses (step 355), and if no pulse is generated, the routine recognizes that the road is flat (step 356), and removes the door holding mode (step 357).

When pulses are generated, the routine checks whether the moving direction is the opening direction or the closing direction (step 350). If it is the closing direction, the routine judges that the road Is an decending road (step 359). If it is the opening direction, the routine judges that the road in an ascending road (step 360). Then, the routine sets the holding force adjustment flag (step 361), resets the pulse counter (step 362), and executes the holding force adjustment control (step 363).

When the door holding mode is removed (step 341), the pulses are counted (step 364), and makes a return without any action if no pulse in present (step 365). Even in a state that the door holding mode is removed, it is necessary to forcibly hold the slide door 3 by the clutch mechanism to block the moving of the slide door 3 through the check mechanism if pulses are generated (step 365), the clutch voltage is not zero (step 366), the road is an ascending road (step 367), the pulses are for the opening direction (step 368), and the slide door 3 is just before the fully opening check position (step 369).

Therefore, the routine sets a door forcibly holding timer flag (step 370), sets the holding force adjustment flag (step 361), resets the pulse counter (step 362), and executes the holding force adjusting control (step 363).

Holding Force Control Routine

Figure 22:
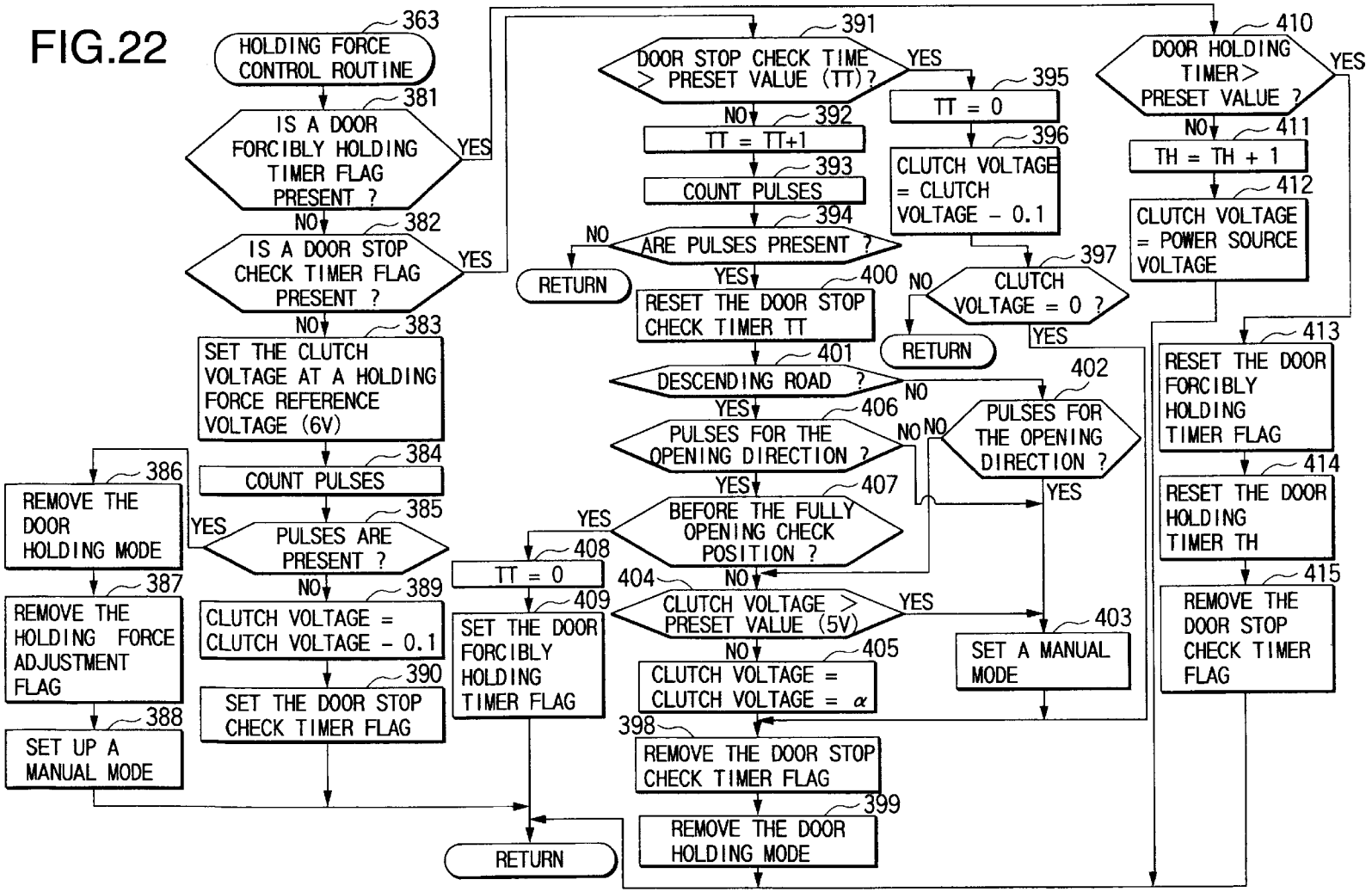
FIG. 22 is a flow chart showing a holding force control routine.

FIG. 22 is a flow chart showing the details of the holding force control routine (step 363). When the vehicle stops at a steeply ascending road or a steeply descending road, the electromagnetic clutch 56 is half-clutch controlled to hold the slide door 3 to prevent the slide door 3 from moving by its weight. To this control, the holding force control routine is provided.

In a door holding mode, a door forcibly holding timer flag and a door stop check timer flag are reset in an early stage (steps 381, 382). Then, the clutch voltage is set at a holding force reference voltage (e.g., 6) (step 393).

In this state, when a pulse is generated (steps 384, 385), the slide door 3 is manually moved. Therefore, the routine removes the door holding mode (step 386), removes the holding force adjustment flag (step 387), sets up a manual mode (step 388), and makes a return.

When no pulse is generated (steps 384, 385), the routine reduces the clutch voltage (step 389), sets the door stop check timer flag (step 390), and makes a return.

In the next holding force adjustment control routine, the door stop check timer flag is set (step 382), the addition process by the timer is repeated till a door stop check timer TT reaches a preset value (steps 391 to 394).

When the door stop check timer TT reaches a preset value, the routine resets the door stop check timer TT (step 395) and decreases the clutch voltage (step 396). This process is repeated and when the clutch voltage is zero (step 397), the routine judges that the road where the vehicle stops in flat and does not move, and resets the door stop check timer flag since there is no need of using the door holding control (step 398), removes the door holding mode (step 399), and makes a return.

When pulses are generated before a count of the door stop check tier TT reaches a preset value (step 394), the routine resets the door stop check timer TT (step 400). If the road where the vehicle stops is a descending road (step 401), and the pulses generated are for the opening direction (step 402), the slide door 3 has moved resisting its weight. Therefore, the routine sets up a manual mode (step 403), resets the door stop check timer flag and removes the door holding mode (steps 398, 399), and makes a return.

When the road is a descending road (step 401), the pulses generated are for the closing direction (step 402), and the clutch voltage is below a preset value (e.g., 5 V), the door has moved by its weight, and the routine sets the clutch voltage at a relatively high (+α) (step 405) to hold the door 3, and resets the door stop check timer flag and removes the door holding mode (steps 398, 399), and makes a return.

When the clutch voltage exceeds a preset value (step 404), the routine recognizes that the slide door 3 in manually is moved and sets up a manual mode (step 403), resets the door stop check timer flag and removes the door holding mode (steps 398, 399), and makes a return.

When the vehicle stopping road is an ascending road (step 401) the pulses for the closing direction are generated (step 406), the routine recognizes that the door 3 has been moved resisting its weight, and sets up a manual mode (step 403), resets the door stop check timer flag and removes the door holding mode (steps 398, 399), and makes a return.

When the vehicle stopping road is a descending road (step 401) and the pulses for the opening direction are generated (step 406), the routine sets the clutch voltage at a relatively high (+α) (step 405) to hold the door 3 if the door 3 is at a mid position on its moving route (step 407) and the clutch voltage in below a preset value (step 404). If the clutch voltage is above the preset value (step 404), the routine recognizes that a manual force acts and sets up a manual mode (step 403), and resets the door stop chock timer flag and removes the door holding rode (steps 398, 399), and makes a return.

When the vehicle stopping road in a descending road (step 401), the pulses for the opening direction are generated (step 406), and the slide door 3 is located before the fully opening check position (step 407), the routine resets the door stop check timer TT (step 408), sets the door forcibly holding timer flag (step 409) to forcibly block the moving of the slide door 3 through the check mechanism, and makes a return.

When in this state, the routine shifts to the next holding force adjustment control routines the door forcibly holding timer flag in set (step 381), and then the slide door 3 is forcibly held while the clutch voltage is set at the power source voltage as a maximum voltage till the door holding timer TH reaches a preset value (steps 410 to 412).

When the door holding timer TH reaches the preset value (step 410), the routine resets the door forcibly holding timer flag (step 413), resets the door holding timer TH (step 414), and removes the door stop check timer flag (step 415). Then, the routine executes again the sequence of steps starting with the step 383 to set the holding force reference voltage.

As seen from the foregoing description, when the clutch mechanism is set in a half-clutch mode, and when the slide door is stopped and held by such a transmission maintenance force an to allow a manual door movement, if the transmission maintenance force exceeds a preset level of force, the slide door control system judges that the door movement is a manual door movement, and shifts its control to an automatic slide mode. Therefore, the slide door is always stopped and held by such a transmission maintenance force as to allow a manual door movement.

When the stopping position of the slide door is at the fully opened position, and the door is further moved in the opening direction, the slide door control system increases the transmission maintenance force to put the slide door immovable, and then stop and holds the slide door by such a transmission maintenance force as to allow a manual door movement. Therefore, the slide door is always held by such a transmission maintenance force an to allow a manual door movement while blocking the moving of the slide door through the check mechanism.

When the slide door moves in the direction opposite to that in which the door moves by its weight, the slide door control system judges that the door movement is caused by a manual operation, stops the holding of the slide door by the half-clutch control, sets the clutch mechanism in a full-clutch mode, and shifts its control to the automatic slide mode. The control may be smoothly shifted to the automatic slide mode not using the half-clutch control.

What is claimed is:

1. A door-holding control system used with a vehicle slide door, comprising:

(A) a slide door moving mechanism that moves the slide door along a vehicle body, said slide door moving mechanism including a drive source and a clutch mechanism that interruptively transmits a mechanical power from said drive source to the slide door;

(B) movement detecting means for detecting a movement of the slide door; and (C) clutch control means for controlling a power transmission maintenance force of said clutch mechanism, wherein said clutch control means controls the power transmission maintenance force to a minimal value of force that stops and holds the slide door between a full open and a full close position, while monitoring an output signal from said movement detecting means.

2. The door-holding control system for a vehicle slide door according to claim 1, wherein, when the power transmission maintenance force exceeds a predetermined value of force, said clutch control means controls the power transmission maintenance force to a value of force that would be required to open and close the slide door.

3. The door-holding control system for a vehicle slide door according to claim 1, wherein, when said movement detecting means has detected that the slide door has moved from a position near a full-open position to the full-open position and said clutch control means has received the signal from said movement detecting means, said clutch control means controls the power transmission maintenance force to a value that would prevent the slide door from moving from the full-open position, and after a preset time elapses, said clutch control means controls the power transmission maintenance force to a minimal value of force required for stopping and holding the slide door.

4. The door-holding system for a vehicle slide door according to claim 1, wherein, when the movement detecting means has detected that the slide door has moved in an opposite direction to a direction in which a weight of the slide door bears, said clutch control means controls the power transmission maintenance force to a value of force required to open and close the slide door.

5. A door-holding control system for a vehicle slide door as claimed in claim 1, wherein, when the power transmission maintenance force exceeds a predetermined value, the controller controls the power transmission maintenance force to a value required to open and close the slide door.

6. A door-holding control system for a vehicle slide door as claimed in claim 5, wherein the controller controls the power transmission maintenance force to a value required to stop the slide door from moving from the fully-opened position when the sensor indicates indicating that the slide door has moved from a position near the fully-opened position to the fully-opened position.

7. A door-holding control system for a vehicle slide door as claimed in claim 6, wherein, after a preset time elapses, the controller controls the power transmission maintenance force to a minimum value required to stop and hold the slide door.

8. A door-holding control system for a vehicle slide door as claimed in claim 5, wherein the controller controls the power maintenance force to a value of force required to open and close the slide door when the sensor indicates that the slide door is moving in a direction opposite to a direction in which a weight of the slide door bears.

9. A door-holding control system used with a vehicle slide door, comprising:

a slide door moving mechanism that moves the slide door along a vehicle body, the slide door moving mechanism including a drive source and a clutch mechanism that interruptively transmits power from the drive source to the slide door;

a sensor that detects movement of the slide door; and a controller that controls a power transmission maintenance force of the clutch mechanism, wherein the controller controls the power transmission maintenance force to a minimum value that stops and holds the slide door between a full open and a full close position while monitoring an output signal from the sensor.

* * * * *